US008108063B2

(12) United States Patent
Agrawal et al.

(10) Patent No.: US 8,108,063 B2
(45) Date of Patent: Jan. 31, 2012

(54) USER INTERFACE FOR COLOR TRANSFER CONTROL IN TEXTILE PROCESSING EQUIPMENT

(75) Inventors: Kavita Agrawal, Austin, TX (US); William K. Bodin, Austin, TX (US); Lakshmi N. Potluri, Austin, TX (US); Gregory W. Rybczynski, Pflugerville, TX (US)

(73) Assignee: International Business Machines Corporation, Armonk, NY (US)

( * ) Notice: Subject to any disclaimer, the term of this patent is extended or adjusted under 35 U.S.C. 154(b) by 1126 days.

(21) Appl. No.: 11/427,133

(22) Filed: Jun. 28, 2006

(65) Prior Publication Data

US 2008/0003904 A1 Jan. 3, 2008

Related U.S. Application Data

(63) Continuation-in-part of application No. 11/425,786, filed on Jun. 22, 2006, now abandoned.

(51) Int. Cl.
*G06F 19/00* (2011.01)

(52) U.S. Cl. ..... 700/143; 700/17; 700/79; 700/130

(58) Field of Classification Search ..... 700/17, 700/79, 80, 83, 130, 143
See application file for complete search history.

(56) References Cited

U.S. PATENT DOCUMENTS

| | | | | |
|---|---|---|---|---|
| 5,698,476 | A | 12/1997 | Johnson et al. | |
| 7,394,565 | B2 * | 7/2008 | Stokes et al. | 358/1.9 |
| 2004/0216500 | A1 * | 11/2004 | Aouad | 68/17 R |
| 2005/0203647 | A1 * | 9/2005 | Landry et al. | 700/83 |
| 2006/0007444 | A1 * | 1/2006 | Oon et al. | 356/406 |
| 2007/0024605 | A1 * | 2/2007 | Motoe | 345/204 |
| 2007/0179641 | A1 * | 8/2007 | Lucas et al. | 700/83 |
| 2007/0216709 | A1 * | 9/2007 | Kojima et al. | 345/619 |
| 2007/0244572 | A1 * | 10/2007 | Farr | 700/12 |
| 2007/0299545 | A1 | 12/2007 | Agrawal et al. | |

FOREIGN PATENT DOCUMENTS

WO WO2005010493 A2 2/2005

OTHER PUBLICATIONS

"Smart Washing Machine", downloaded on Apr. 6, 2006 from http://www.halfbakery.com/idea/smart_20washing_20machine?op=aye.
Nice, Karim, "How Washing Machines Work", downloaded on Mar. 7, 2006 from http://home.howstuffworks.com/washer.htm/printable.

(Continued)

*Primary Examiner* — Kakali Chaki
*Assistant Examiner* — Nathan Laughlin
(74) *Attorney, Agent, or Firm* — Robert H. Frantz; Jill A. Poimboeuf

(57) ABSTRACT

Dye transfer in a dying machine or washing machine is controlled via a user display by showing a dialog having with color level indicators for setting a threshold to trigger a dye transfer control action, and with threshold adjustment controls; responsive to the threshold adjustment controls, changing transfer control parameters for initiation of control actions; responsive to the threshold being triggered, performing a control action by opening an abatement valve communicative to a reservoir holding a substantially liquid or gel form of a dye scavenger or inhibitor substance; and continuing to monitor the triggering of the threshold, and responsive to the threshold being triggered, continues to open the abatement valve until at least one condition is detected of a desired color threshold being met, a desired color threshold being regained, until a user intervention occurs, and until a particular wash stage is activated.

21 Claims, 21 Drawing Sheets

OTHER PUBLICATIONS

"Godrej Fully Automatic Fuzzy Logic Washing Machine", downloaded on Mar. 7, 2006 from http://indiatimes.com.
"Keeping Color from Bleeding When Washing Clothing", downloaded on Mar. 7, 2006 from http://www.thriftyfun.com.
"Cleaning Products: Shout Color Catchers", downloaded on Mar. 7, 2006 from http://www.krbc.tv.
"New 'Smart' Washing Machine Does Much of the Dirty Work", downloaded on Mar. 7, 2006 from http://www.clarionledger.com.
Salam, M. A., "Study of Color Fastness Properties onto Bleached Sulfonated Jute-cotton Blended Fabrics with Basic Dyes", Journal of Textile and Apparel, Technology and Management, vol. 4, Issue 4, Summer 2005.
"Shout Color Catcher", downloaded on Mar. 7, 2006 from http://www.shoutitout.com.
USPTO; examination correspondence in related U.S. Appl. No. 11/425,786, filed Jun. 22, 2006 by Kavit Agrawal, now abandoned.

* cited by examiner

USER INTERFACE FOR COLOR TRANSFER CONTROL IN TEXTILE PROCESSING EQUIPMENT

CROSS-REFERENCE TO RELATED APPLICATIONS (CLAIMING BENEFIT UNDER 35 U.S.C. 120)

This application is a continuation-in-part of U.S. patent application Ser. No. 11/425,786, filed Jun. 22, 2006 now abandoned prior to the first office action on the merits, which was commonly assigned with the present patent application.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

The related U.S. patent application Ser. No. 11/425,786, filed Jun. 22, 2006, is incorporated by reference in its entirety.

BACKGROUND OF THE INVENTION

1. Field of the Invention

This invention pertains to technologies for controlling machines and processes in which fabrics are washed, laundered, dyed, or otherwise treated in a liquid bath. This invention especially relates to controlling, inducing, or abating the transfer of coloration to or from fabrics in such machines or processes.

2. Background of the Invention

Present day clothes washing technology fails to adequately address a problem of color bleeding from one clothing article to another. This is true of residential clothes washing machines, as well as commercial and industrial clothes washing machines. In this disclosure, we will refer to all machines and processes which are intended for washing fabric-based articles, whether they be clothes, rugs, bedding, linens, etc., collectively as "washing machines", or as a "washing machine" in the singular. We will also use the term "article" to collectively refer to fabric-based items such as clothing, bedding, rugs, linens, etc. Further, the liquid solution and/or suspension in which the articles are washed will be referred to as a "bath liquid" in this disclosure. Groups of articles which are washed or otherwise processed together will be referred to as a "load" or "wash load".

In one scenario, a newly purchased and previously unwashed article is introduced into a washing machine with other articles in a load. Depending on the color content and fabric composition of the unwashed article, the coloring substance (e.g. dye, pigment, etc.) may be released during the wash, and may settle in one or more of the other articles in the wash with it. This is called "color bleed". It occurs with large color differences, such as placing a new red-colored item in a wash with light-colored items. In some instances, bath temperature or detergent may intensify the color bleed problem.

Several attempts have been made to attempt to avoid this problem. One attempt uses labeling of the articles, with warnings, icons, and symbols, that stipulate to wash a new item individually for a first wash, to wash like colors together, and to observe certain detergent and bath temperature instructions (e.g. wash cold only, no bleach, etc.). However, these labels are often not followed, usually by mistake by including a new item inadvertently in a wash group, by forgetting to read the label, or other user error.

Another attempt that has been made is to pre-wash articles before they are sold through retail stores, or even pre-washing fabrics before they are cut into panels and pieces for assembly into articles. However, this adds to the cost of the articles, which can be an economic disadvantage to the retail sales of the item. For some fabrics, pre-washing may increased the difficulty of handling the fabric during processing steps such as cutting, stitching, sewing, hemming, etc.

A decidedly higher-technology approach has been attempted by some makers of washing supplies in the form of a chemically-treated, disposable sheet which is introduced into the wash bath. The chemicals disposed on the sheet are of a nature that they bind to or absorb many types of coloring substances which are free floating in the bath liquid. While this approach may partially abate color bleeding, it remains incomplete in its effect, as each sheet can only remove a finite amount of coloring substance from the bath, and each sheet can only remove coloring substance with which it comes in contact. This still leaves many scenarios in which coloring substance may settle into articles, causing some amount of color bleed. Further, this approach can be expensive, and is prone to error by the user (e.g. forgetting to drop a sheet in each wash load).

In order to completely avoid color bleeding in common washing machines, operators are required to fully and correctly (a) sort articles by compatibility factors such as color; (b) follow initial or first-wash instructions posted on tags; (c) select appropriate wash settings; and (d) use appropriate wash additives (e.g. detergent, softener, etc.). This has proven for many years to be an onerous set of user requirements over the years, and a solution has eluded industry.

As a result, many articles are ruined every year. This results in economic loss to consumers to replace the damaged articles. And, it promotes brand disloyalty for clothing manufacturers because consumers often perceive color bleeding as a quality problem associated with a particular brand.

Further, many systems, such as industrial fabric dying systems, are employed to intentionally cause the transfer of dye to fabric items. Due to variations in fabric fibers, fabric content, water chemistry, and dye consistency, these processes are notoriously difficult to control. For example, using a batch or sample of a fabric to be dyed, and a sample quantity of dye, a set of parameters may be developed to establish a routine for dying larger quantities of fabric to achieve a certain color and shade. However, due to variations in the fabric, such as natural fibers being incorporated from different sources or geographic regions, each load of fabric to be dyed may take the dye differently from the pilot batch. Similarly, dying substances may also vary in large quantities, due to different plant and animal sources employed to render the dye, and due to changes in the chemistry of the water used in the bath (e.g. more or less minerals may change the transfer characteristics of the dying process).

As a result, commercial dying processes are not as accurate or efficient as desired, and often fabrics of undesirable color, shade or hue are yielded. These substandard fabrics are often scrapped or allocated to lower cost products, such as shredding the fabric for use in pillow fill, or using the fabrics for lower quality garments.

BRIEF DESCRIPTION OF THE DRAWINGS

The following detailed description when taken in conjunction with the figures presented herein provide a complete disclosure of the invention.

SUMMARY OF THE INVENTION

The inventors of the present invention and the related invention have recognized a problem unaddressed in the art in that a washing machine user's compliance with washing instructions, clothing labels, detergent labels, and consistency of use of color bleed products cannot be relied upon for reducing or stopping color bleed. The inventors have also realized that control of commercial fabric dying systems is problematic, inaccurate and inefficient.

The inventors have realized that certain combinations of circuitry, automatic logic, and machine apparatus components may be employed according to the present invention to automatically detect color bleed in a wash load, and to automatically take abatement actions to reduce, stop, or minimize damage caused by color bleed.

Using the related invention, color sensing technology is used to monitor color levels, and changes in color levels, in the washing machine bath. Enhanced machine control logic determines when colors are bleeding by detecting a change in the bath liquid color. The control logic then takes one or more abatement or alerting actions, including but not limited to:

(a) alerting the user of the color bleeding;
(b) draining the bath liquid;
(c) halting agitation or spinning of the load; and
(d) releasing a color substance absorbing or binding agent into the bath liquid.

The present invention provides an easy-to-use interface for a user to specify color bleed and color transfer operational parameters, using primary color components, such as red/green/blue, and using an easily configured actions menu.

Other aspects and embodiment variations will be apparent in the following detailed description of the invention.

DETAILED DESCRIPTION OF THE INVENTION

Unlike others in the art who have attempted to solve the problem of color bleed in washing machines and color transfer in industrial dying machines, the inventors of the present invention have recognized that users may not be relied upon for active control and abatement of color bleed for their failure to consistently and fully follow all procedures, directions, and restrictions set forth by washing machine user's manuals, labels on washable articles, and labels on wash additives (e.g. detergent, softener, color-bleed-stop sheets, etc.). Based on these discoveries, the inventors have developed the following logical processes, systems, services, and computer-readable media to solve these unrecognized problems in the art.

The Related Invention

The user interface of the present invention is well suited for control and configuration of a system such as that described in the related and incorporated patent application. The present invention, however, is useful for other applications and is not restricted to use with the related invention. For better understanding of the present invention, we first review the details of the related invention.

Figure 1:
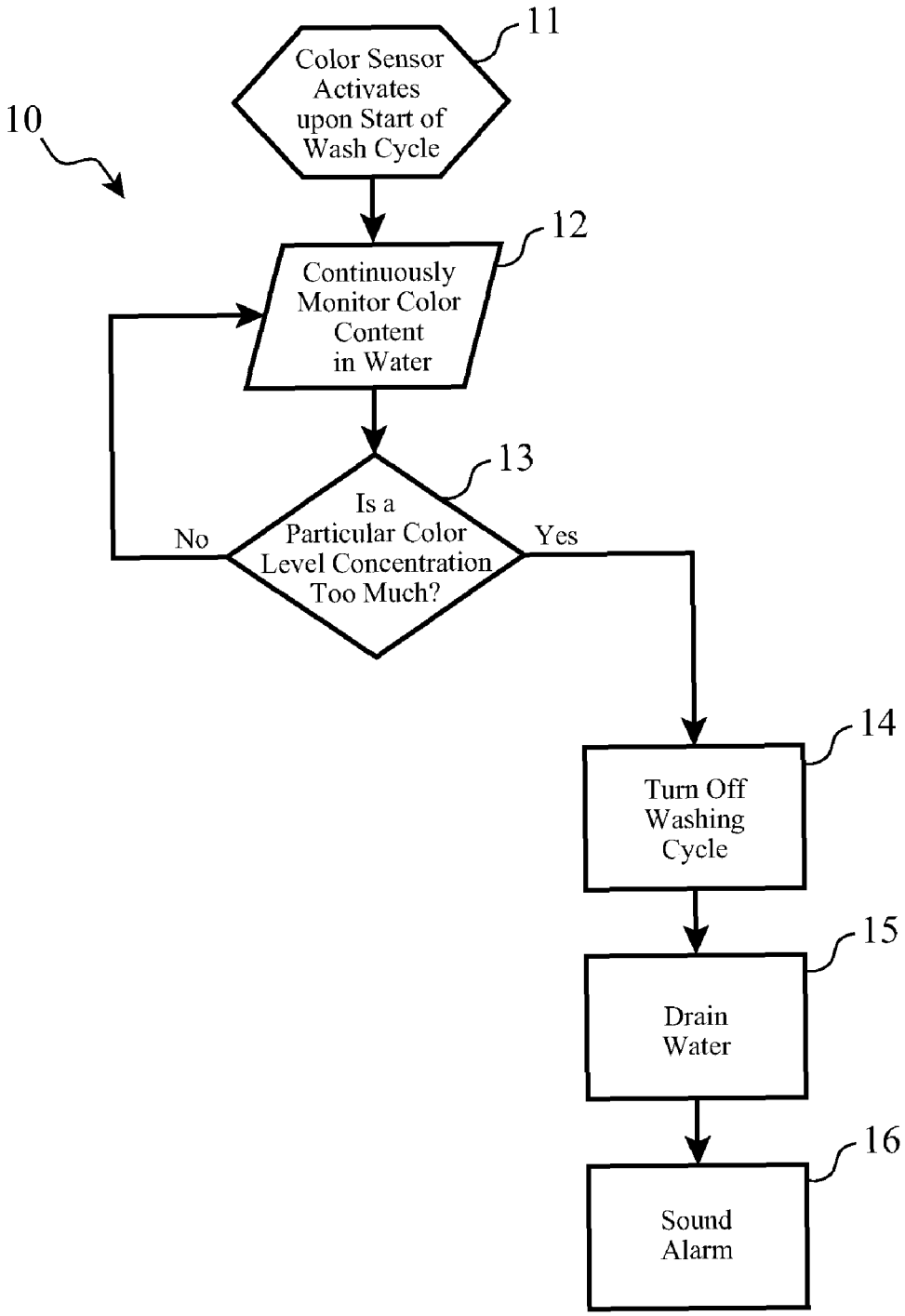
FIG. 1 depicts a basic embodiment logical process according to the present invention.

Turning now to FIG. 1, a basic logical process (10) according to the related invention is shown. A color sensor situated so as to measure the color of the bath liquid in the washing machine is activated (11) during the wash cycle, and continuously monitors (12) the color content of the bath liquid. If during the wash cycle, a particular color or colors is detected to exceed a threshold (13), then certain abatement actions are taken, such as stopping the wash cycle (14), draining the bath liquid from the washing machine, and sounding an alarm to the user. As will be apparent in the following disclosure, this is just one combination of logical reactions which can be taken based upon detection of color bleed.

Figure 5:
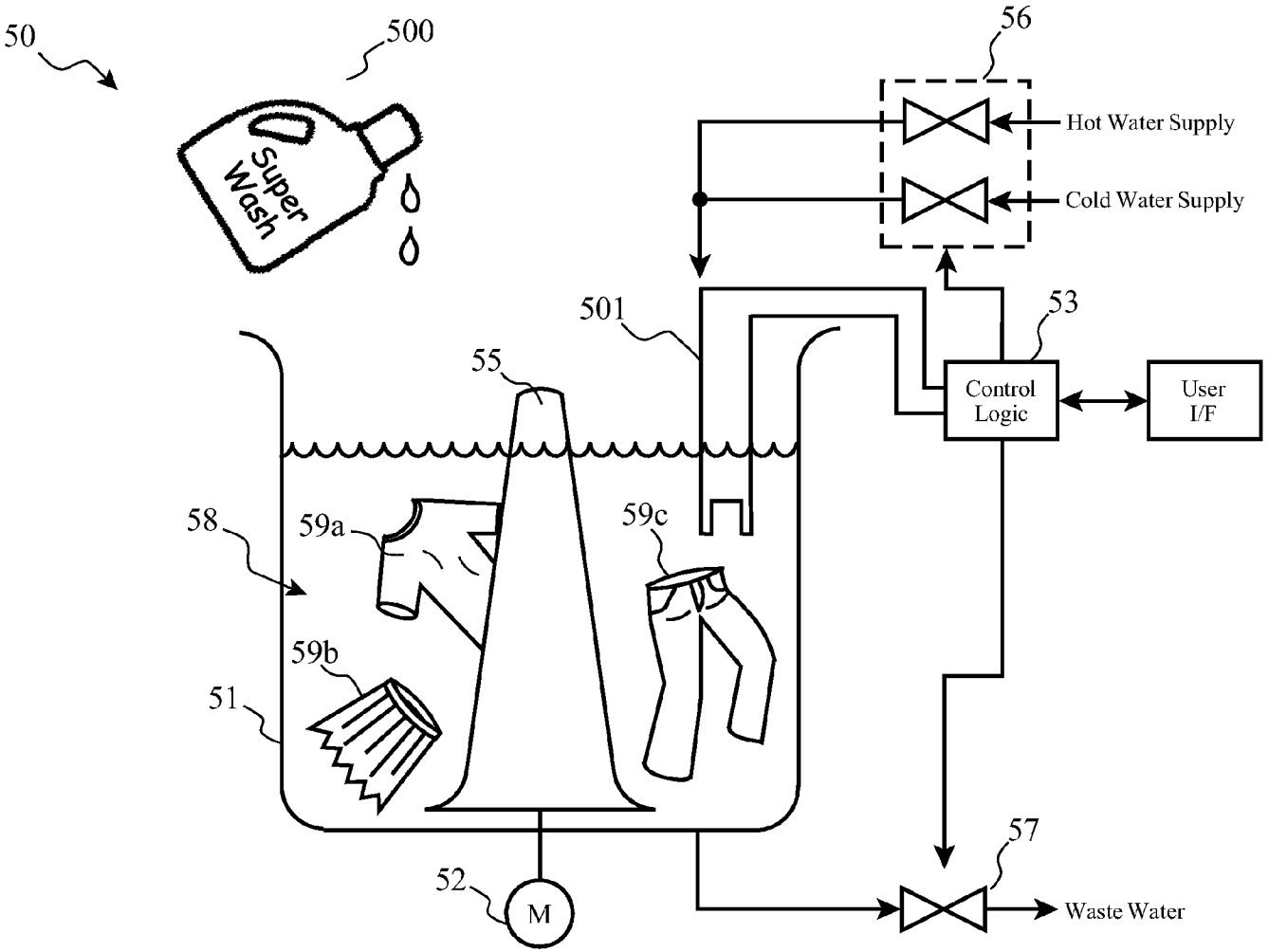
FIG. 5 shows the organization of a washing machine incorporating the enhancements of the invention.

Basic Washing Machine Embodiment. Turning to FIG. 5, the components of a typical washing machine incorporating the enhancements according to the invention (50) is schematically shown. Washable articles (59*a*, 59*b*, 59*c*) are placed in a tub or drum (51), which is then filled with water, usually under the control of control logic (53) and a user interface (54) activating one or more controllable fill valves (56). For example, the user interface typically allows the user to select a hot wash, a warm wash, or a cold wash. Hot washes are suitable for whites and heavy fabrics, while cold washes are suitable for delicate fabrics and brightly-colored fabrics, for example. Further, the user interface typically allows the user to select a load size, such as small, medium, and large, which is used to partially or completely fill the tub (51) based upon the load size. Additionally, the user typically may select a cycle type, such as gentle or heavy, that will determine the agitation style and strength employed during the wash cycle.

Next, a user typically manually pours or otherwise adds one or more wash additives (500) to the bath liquid (58), such as detergent, fabric softener, bleach, disinfectant, etc. Many of these additives are provided in liquid form, while others are provided in powdered or solid form.

When the control logic determines that the proper bath level has been reached, it activates a motor (52) which engages an agitator (55), and typically also oscillates or rotates the tub (51).

Following the completion of the initial cycle with detergent, most wash cycles are then continued by the control logic opening a controllable drain valve (57) to allow the soiled bath liquid to drain from the tub (51). In some cycles, this will be followed by a drying spin cycle which is achieved by spinning the tub (51) by the motor (52) for a period of time to use centrifugal force to drive additional bath liquid from the articles and into the drain.

Finally, a rinse cycle is usually completed in which the control logic closes the drain valve (57), opens the water supply valves (56) to fill the tub (51) with fresh bath liquid, and then performs another cycle of agitation with the motor (52), spinning and draining. In some rinse cycles, an automatic softener dispenser (not shown) with valve is operated by the control logic so that rinse cycle softener may be added to the rinse bath liquid.

During any of these periods of the wash cycle, coloring substance may be released from one or more of the articles (59*a*, 59*b*, 59*c*) into the bath liquid (58), and conducted to one or more of the other articles in the wash load. This coloring substance will affect the color of the bath liquid (58), as well. To detect this, a color sensor (501) is fitted to the washing machine (50) and interfaced to the enhanced control logic (53). Upon detection of a color change in the bath liquid, certain abatement actions are taken automatically by the control logic (53).

Figure 6:
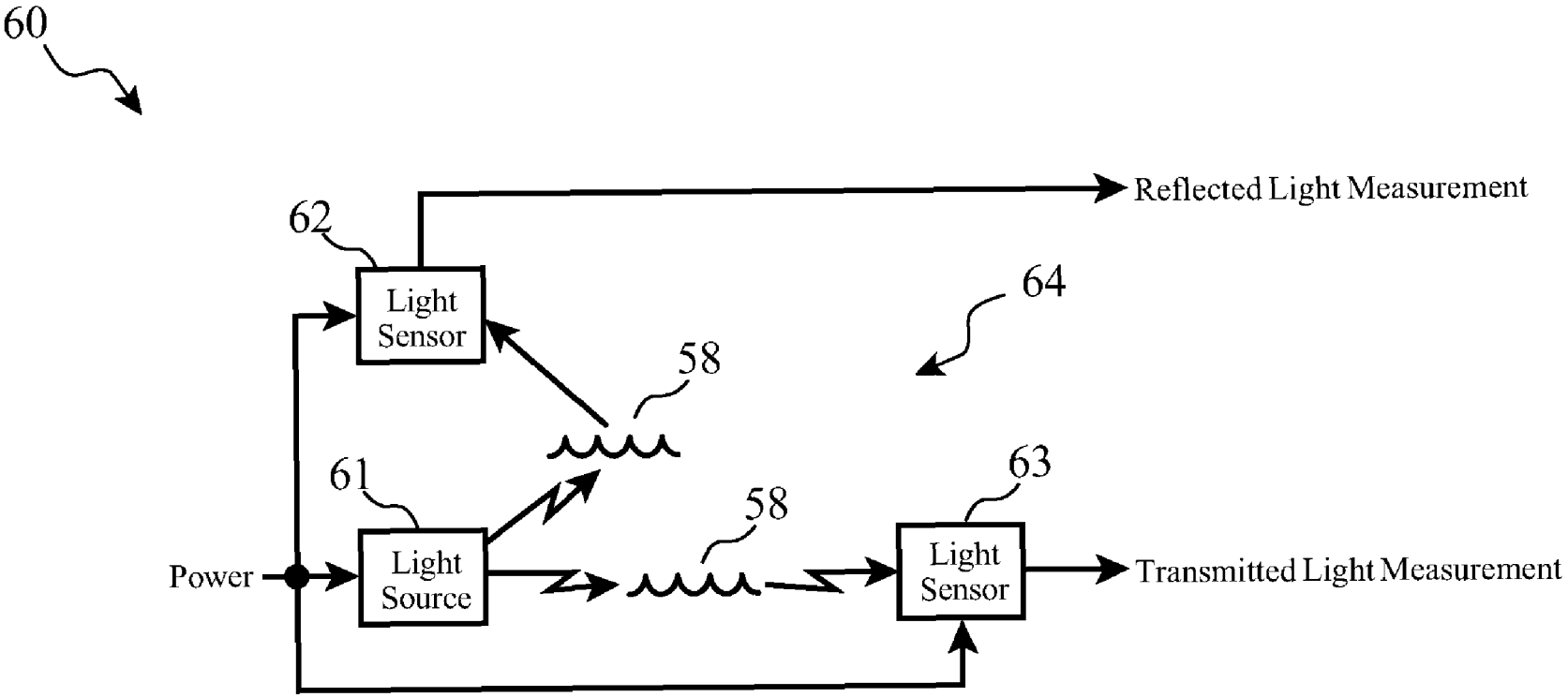
FIG. 6 provides details of the color sensor portion of the invention.

Color Sensor Arrangement. Turning to FIG. 6, a functional diagram of a color sensor (60) according to the invention is shown. This arrangement provides for sensing of bath liquid color by transmitting through the bath liquid, by reflecting light on the bath liquid, or a combination of both. Transmitting light through the bath liquid is possible unless the transparency of the liquid falls to a level below which the light source cannot excite the light sensors. In a situation where the bath liquid has become substantially opaque, reflection of light on the bath liquid may provide an adequate measurement of the color of the liquid.

Further, the light sensors of the embodiment utilize a full visible spectrum of light, but in alternate embodiments, certain colors or bands of light may be used. For example, red tends to be a color or dye which bleeds more often that others, so an embodiment of the light sensor may utilize only a red light source and a red light sensor.

As shown in FIG. 6, a gap (64) is formed between a light source (61), and one or more light sensors (62, 63), in which the bath liquid (58) may transmit or reflect the light from the source to the sensor(s). Measurements or signals representing measurements of one or more colors of light are then output to the control logic of the washing machine for use in the logical processes of the invention.

Figure 11:
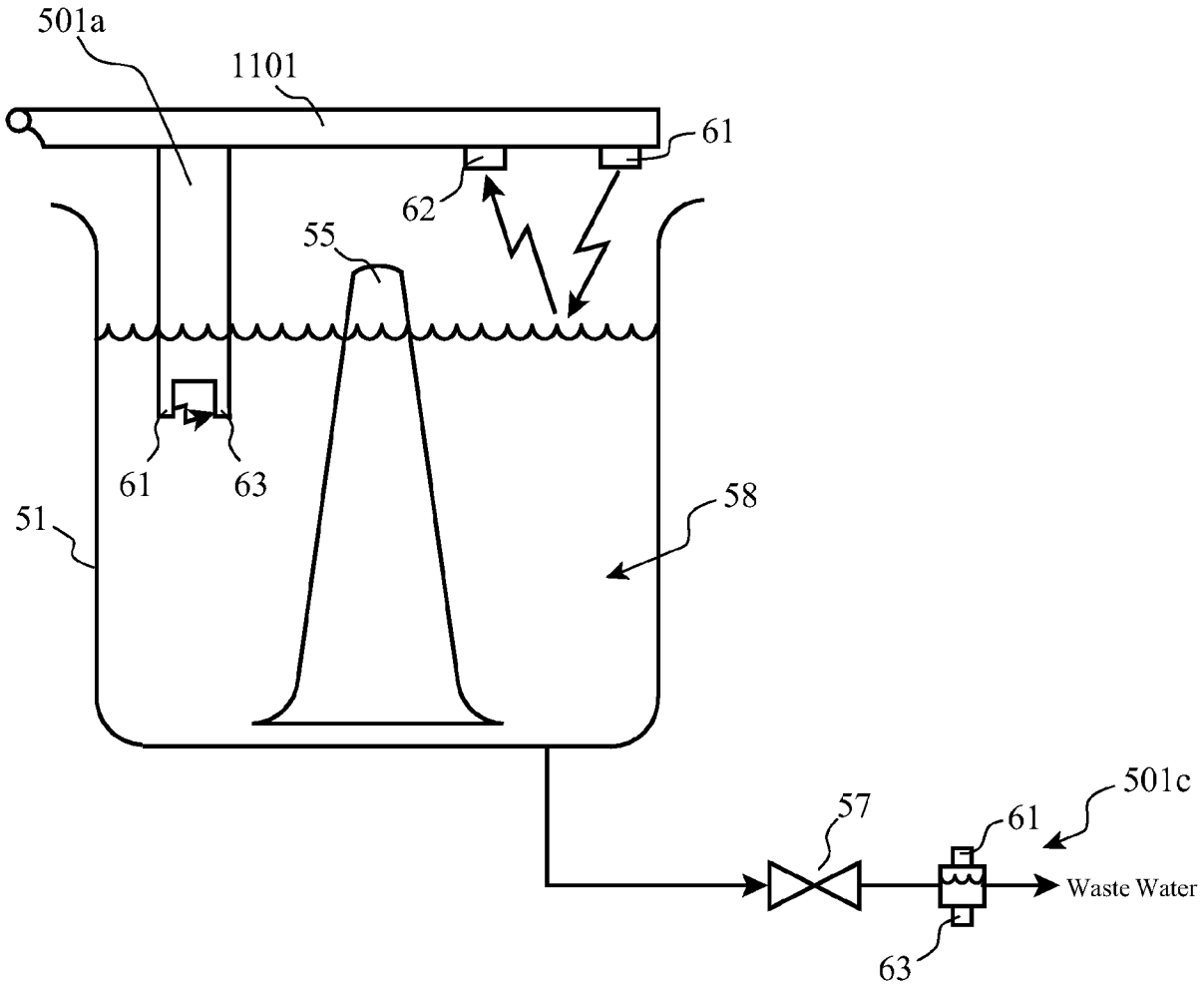
FIG. 11 illustrates three mechanical embodiment options for the placement of the color sensor.

FIG. 11 illustrates three available mechanical embodiments of the sensor arrangement (501*a*, 501*b*, 501*c*). In a first embodiment (501*a*), a structure depends from the hinged lid (1101) to immerse the emitter/sensor pair (61, 63) into the bath liquid (58). In the second embodiment (501*b*), a emitter/sensor pair (61, 62) is affixed to the hinged lid (1101) in a manner which allows for a reflective measurement to be taken on the surface of the bath liquid (58). In a third embodiment (501*c*), a small reservoir is placed in-line following the drain valve (57), across which a emitter/sensor pair (61, 63) is placed. In this third arrangement, the control logic can periodically momentarily open the drain valve to obtain a small sample of the current bath liquid.

Logical Control Processes. Many washing machines now include an embedded microcontroller to perform control logic, while others remain electro-mechanically controlled using timers and actuators. The logical processes of the related invention may be realized as either modifications to microcontroller firmware, as electromechanical controls, or as a combination of both.

Figure 7:
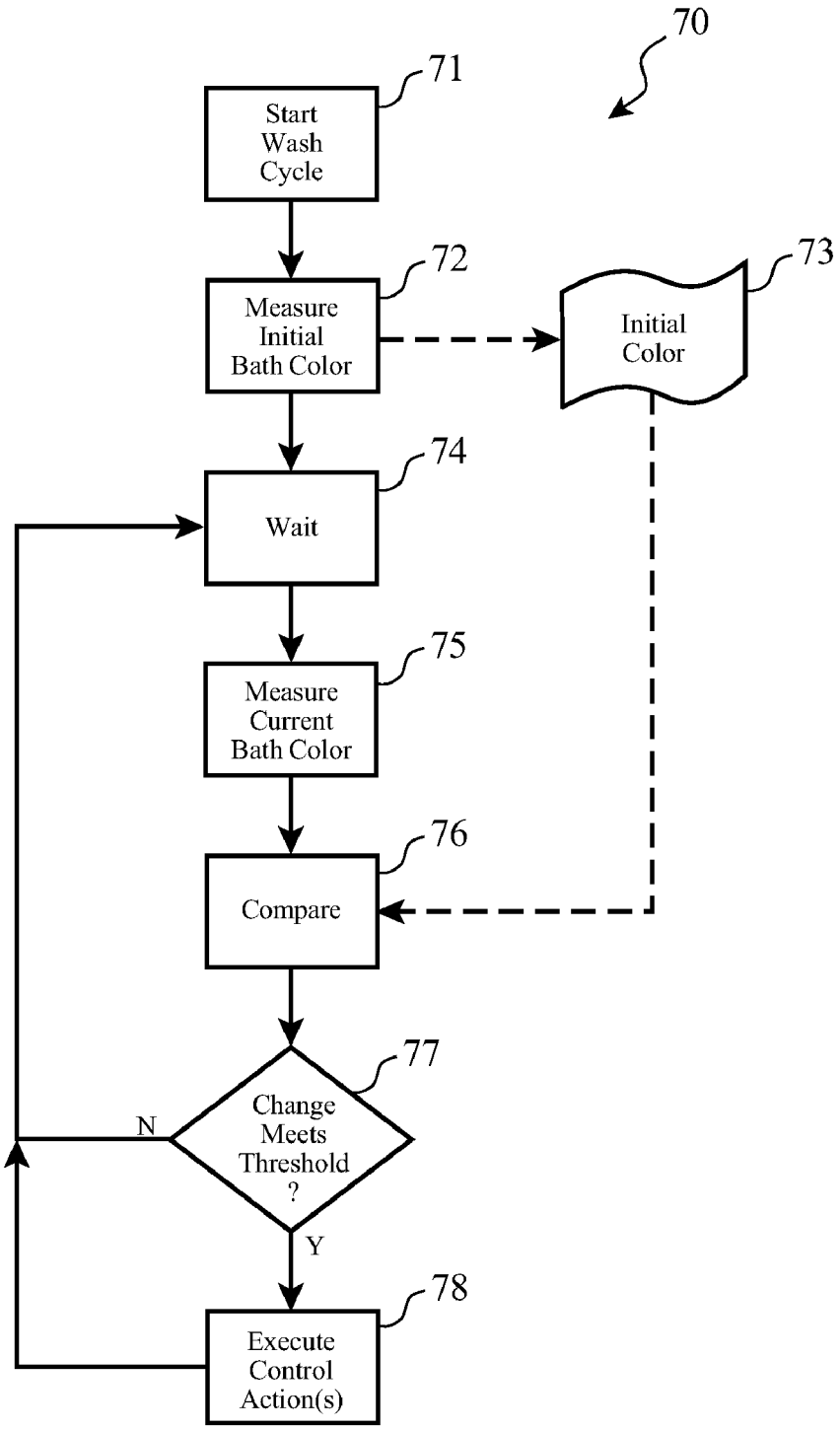
FIG. 7 sets forth a logical process according to the invention for detecting bath color change.

FIG. 7 sets forth a logical process (70) according to the invention for monitoring the bath liquid for indications of color bleed. When the wash cycle is started (71), the bath color is optionally measured (72) to establish an initial bath color (73), which is stored or maintained. Then, periodically (74), or optionally continuously, the current bath color is measured (75). If an initial bath color (73) was recorded, then the current color is compared (76) to the initial color, and it is determined if one or more of the colors has increased beyond a threshold value (77). If an initial bath color was not measured, the current bath color can be compared against one or more color thresholds (77). If any thresholds are exceeded, then one or more bleed control actions are executed (78).

It should be noted that a number of measurements of color and transparency may be made during these steps. Individual colors may be measured in sets, such as a set of primary colors (e.g. red/blue/green, cyan/magenta/yellow, red/yellow/blue, etc.), and then their individual strengths compared to thresholds. Further, these can be combined to a composite brightness-darkness level, or to a transparency-opaqueness level, which may also be compared to thresholds. Alternatively, single colors, such as the problematic red, may be measured and compared.

Figure 8:
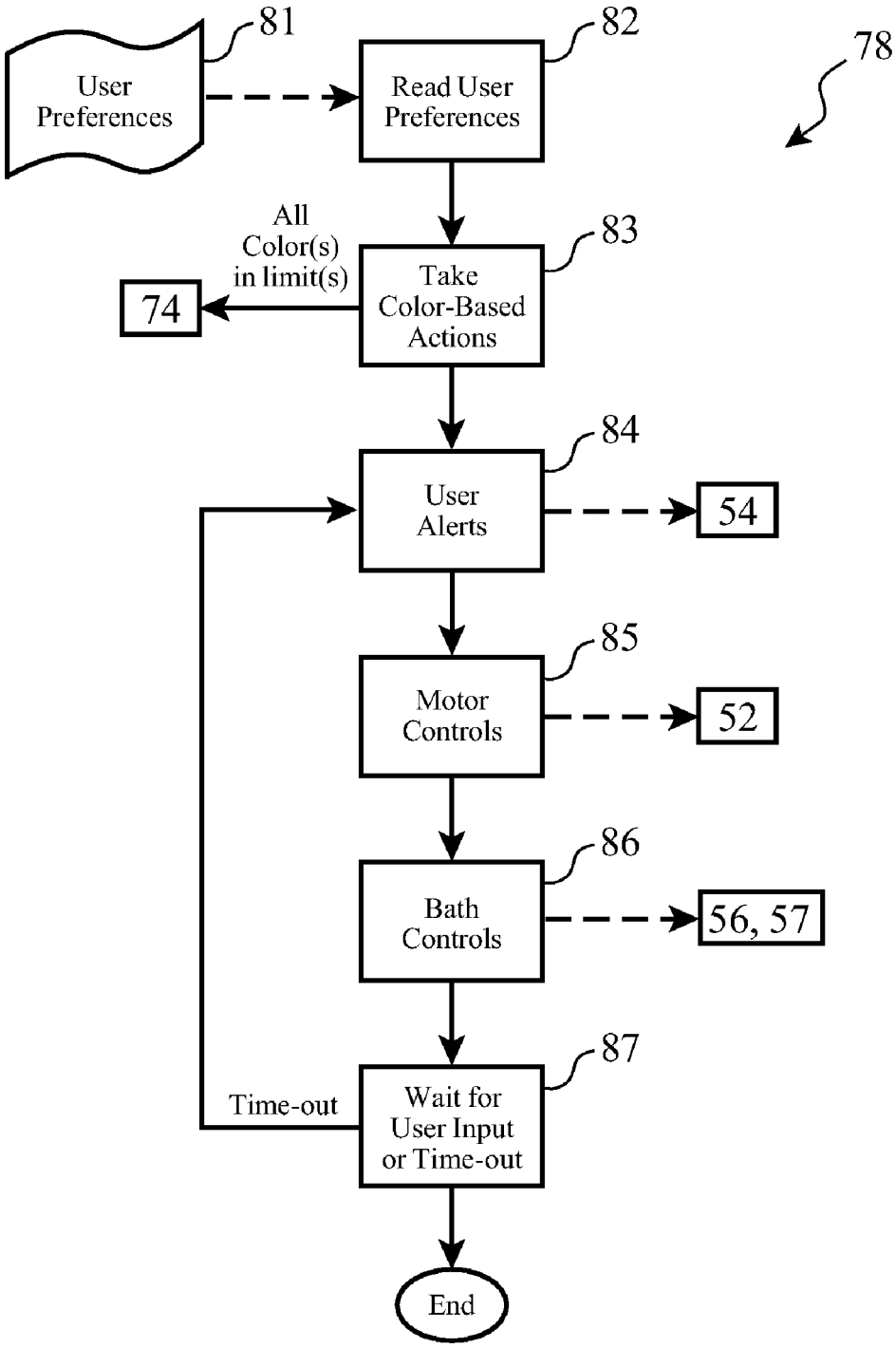
FIG. 8 sets forth a logical process according to the invention for taking action responsive to detection of color bleed in a wash load.

Turning to FIG. 8, an example logical process according to the related invention is shown for executing one or more bleed control actions (78). According to one embodiment, a set of user preferences (81) are configured to indicate the user's desired actions for specific conditions. In alternate embodiments, these preferences may be set by the machine manufacturer. The user preferences are accessed (82), and if all colors appear to be within limits according to the preferences, the monitoring process is continued (74). Otherwise, if one or more thresholds, such as more color than desired, less transparency than desired, or less brightness than desired, are exceeded, then one or more control actions may be performed in accordance with the preferences:

(84) issue an alert via the user interface (54), such as a buzzer, tone, light, or other user signal;

(85) change the motor controls (52) to stop or slow the agitator, to stop or slow the tub action, or a combination of agitator and tub action changes; and (86) change the bath control valves (56, 57) to drain the bath liquid; to fill the tub with cold, warm or hot water; or a combination of draining and filling.

The control logic may then wait for user input, such as a cancellation of the control action (e.g. resume normal wash cycle), cancellation of the wash cycle (e.g. move control states to draining, spinning, rinsing, etc.), or to change the user preferences.

Optionally, if no user input is received within a certain time, additional control actions (84, 85, 86, 87) may be taken. This allows for multiple stages of abatement actions. For example, initially, the agitation and tub rotation may be stopped, and a user alert issued for one minute while the wash load remains still in the bath liquid. If no user input is received after the one minute alert, the tub may be drained, and a fresh fill of cold water may be made while a second user alert is issued.

Enhanced Embodiment Providing Color Blocking Additive. A number of chemicals are known in the art which absorb free coloring substance from a bath liquid. For example, U.S. Pat. No. 5,698,476, and patent(s) referenced by this patent, disclose certain chemical agents may be embedded into sheets for scavenging dye or inhibiting dye transfer, including (col. 6 lines 48 to col. 7 line 30):

" . . . In U.S. Pat. No. 4,380,453 (the U.S. Pat. No. '453 patent), for example, it was disclosed and claimed that a cellulose-supported dye scavenging material could be used to control undesirable or random dye transfer in a liquid bath. The dye scavenging material that was taught and claimed comprised a quaternary 2-hydroxy-3-halopropyl compound. However, from a study using increasing numbers of signal sheets according to the U.S. Pat. No. '453 patent, Applicants have demonstrated that the performance of the U.S. Pat. No. '453 product is far from optimal. For instance, in order to achieve the same dye transfer inhibition performance as approximately 1.75 grams of PVP incorporated onto a signal/DTI sheet according to one embodiment of the present invention, Applicants determined that approximately 32 individual 8 in. times. 11 in. signal sheets according to the U.S. Pat. No. '453 patent would be required. Additional studies confirmed that the levels of dye transfer inhibitor introduced onto a signal sheet to generate a signal/DTI sheet could be optimized to simultaneously achieve an effective color signal, inhibit dye transfer, offer good hand feel and provide a reasonable sheet size at a reasonable cost, while not adversely affecting cleaning, brightening or whitening performance of the detergent in the wash liquor.

Materials which may be acceptable as dye transfer inhibitors include, but are not necessarily limited to: polyvinyl pyrrolidone (PVP); polyvinyl alcohol (PVA); polyvinyl imidazole (PVI); polyamine-N-oxides such as polyvinylpyridine-N-oxide; hydrophobicly or cationicly modified PVP; copolymers of any of the foregoing; cationic starches; minerals such as magnesium aluminate and hydrotalcite; proteins and hydrolyzed proteins; polyethylene imines; polyvinyl oxazolidone; enzymatic systems including peroxidases and oxidases; oxidants; cationic and amphoteric surfactants; as well as propylene oxide reaction products; polyamino acids such as polyaspartic acid or polyhistidine; block co-polymers of ethylene oxide and propylene oxide, for example, those known by the trade name Pluronic® (BASF); polyamines and polyamides; cationic starches; methyl cellulose; carboxyalkyl celluloses such as carboxymethyl and carboxyethyl cellulose; guar gum and natural gums; alginic acid; polycarboxylic acids; cyclodextrins and other inclusion compounds; and mixtures thereof, etc. In addition to the foregoing, and depending on processing steps and/or conditions, certain dye transfer inhibitors may also be comprised of the same material as the dye absorber, and vice versa."

Figure 9:
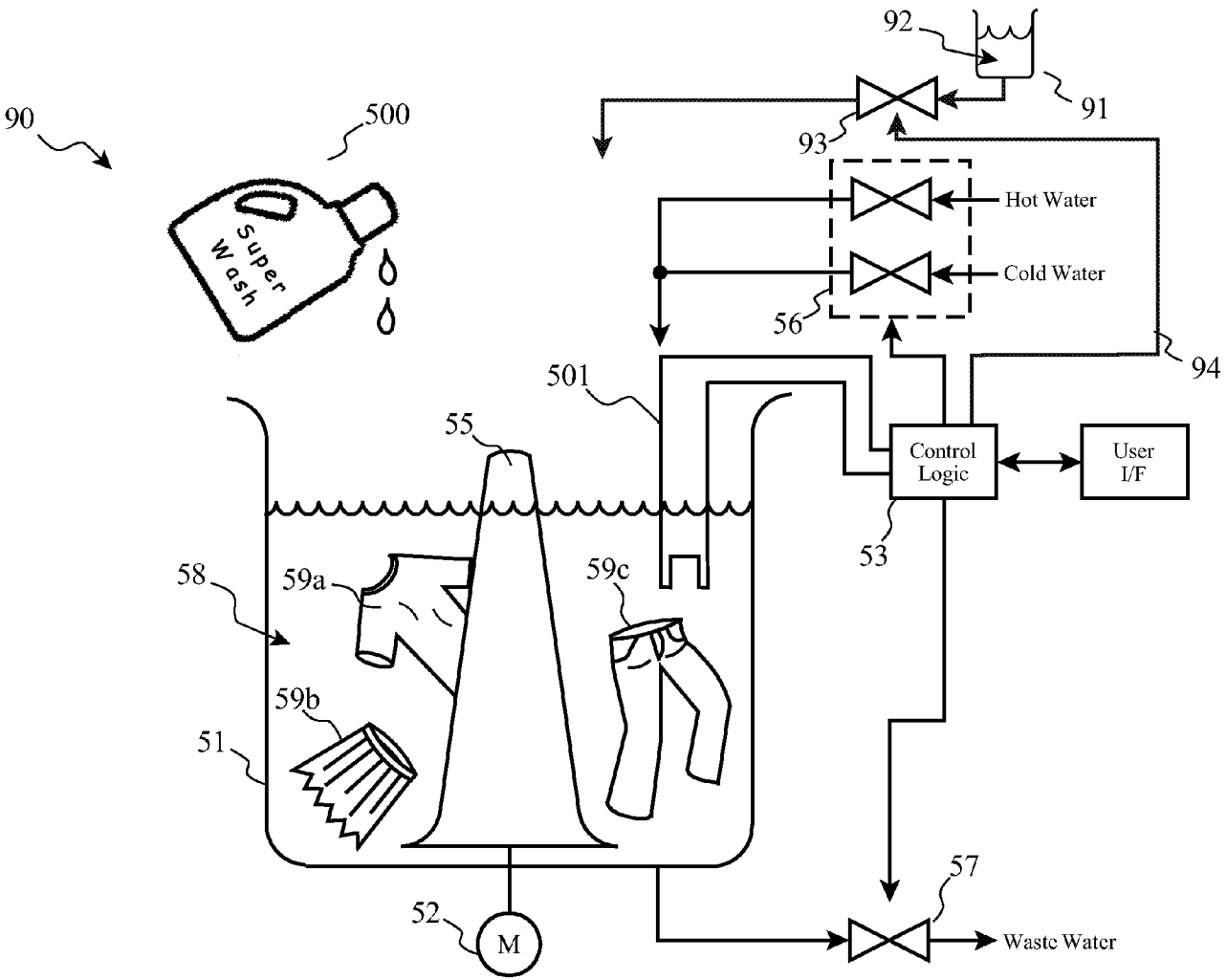
FIG. 9 shows an alternate organization of a washing machine incorporating the enhancements of the invention.

While these two patents are directed towards affixing these scavenger and inhibitor substances to a substrate, such as a disposable sheet material, the related invention utilizes these substances in a substantially liquid or gel form (92) held in a reservoir (91), as shown (90) in FIG. 9. An abatement liquid valve (93) is controlled by the control logic (53) to operable release an amount of the abatement liquid (92) into the bath liquid (58) as a control action. In one embodiment, this reservoir (91) and valve can be a preexisting liquid fabric softener reservoir and valve, re-purposed for this use. In another embodiment, a new reservoir and valve are added to the existing washing machine architecture for this use.

Figure 10:
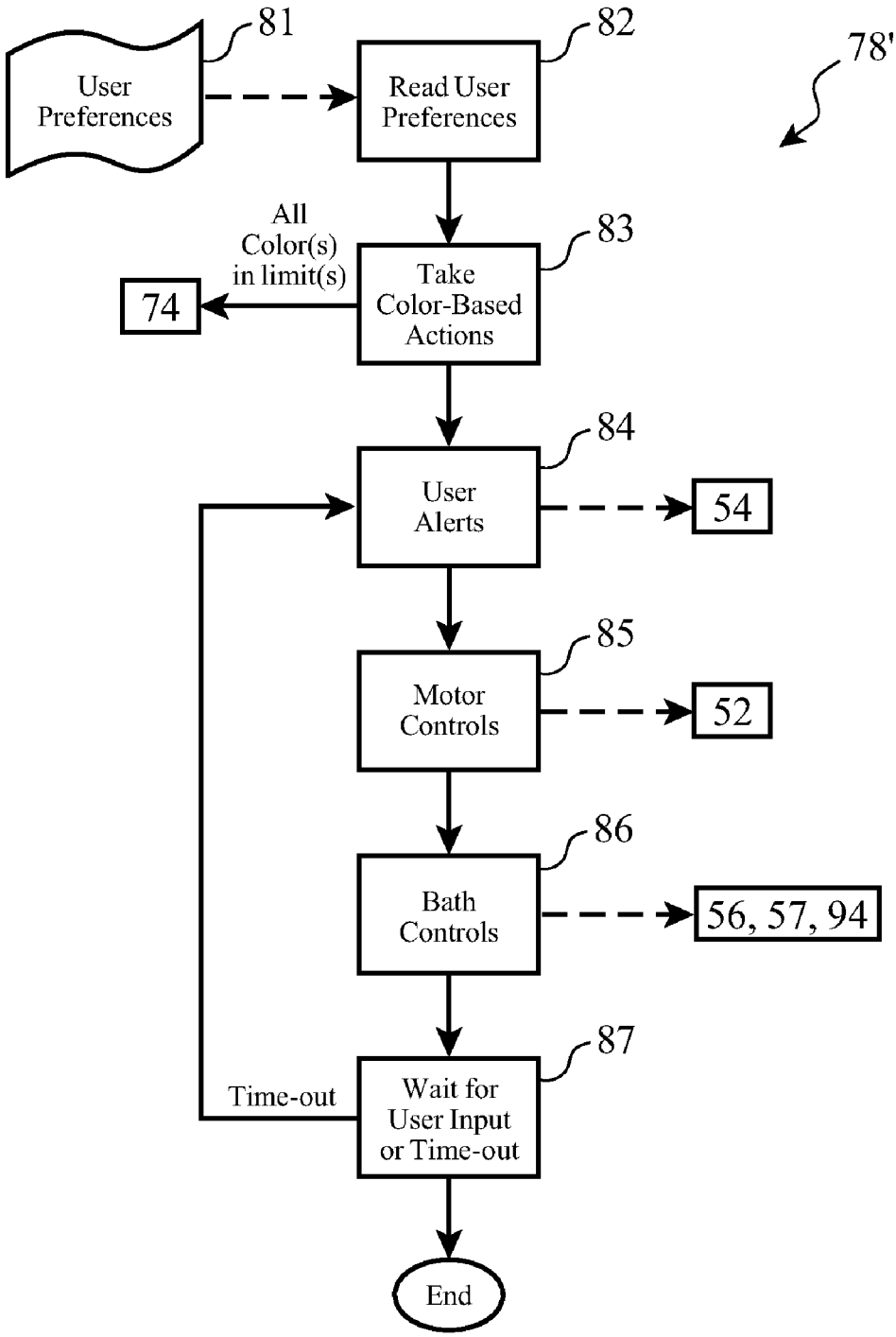
FIG. 10 sets forth an alternate logical process according to the invention for taking action responsive to detection of color bleed in a machine as shown in FIG. 9.

In a further enhanced embodiment, the control logic of the related invention is modified to operate (94) the new valve (93) as a control action, as shown (78') in FIG. 10. Optionally, the control logic may continue to monitor the color content of the bath liquid, periodically releasing additional color bleed abatement liquid into the bath liquid until a desired color threshold is met or regained, until a user intervention occurs, or until other stages of action are activated.

User Interface: Dye Limit Settings

Figure 12:
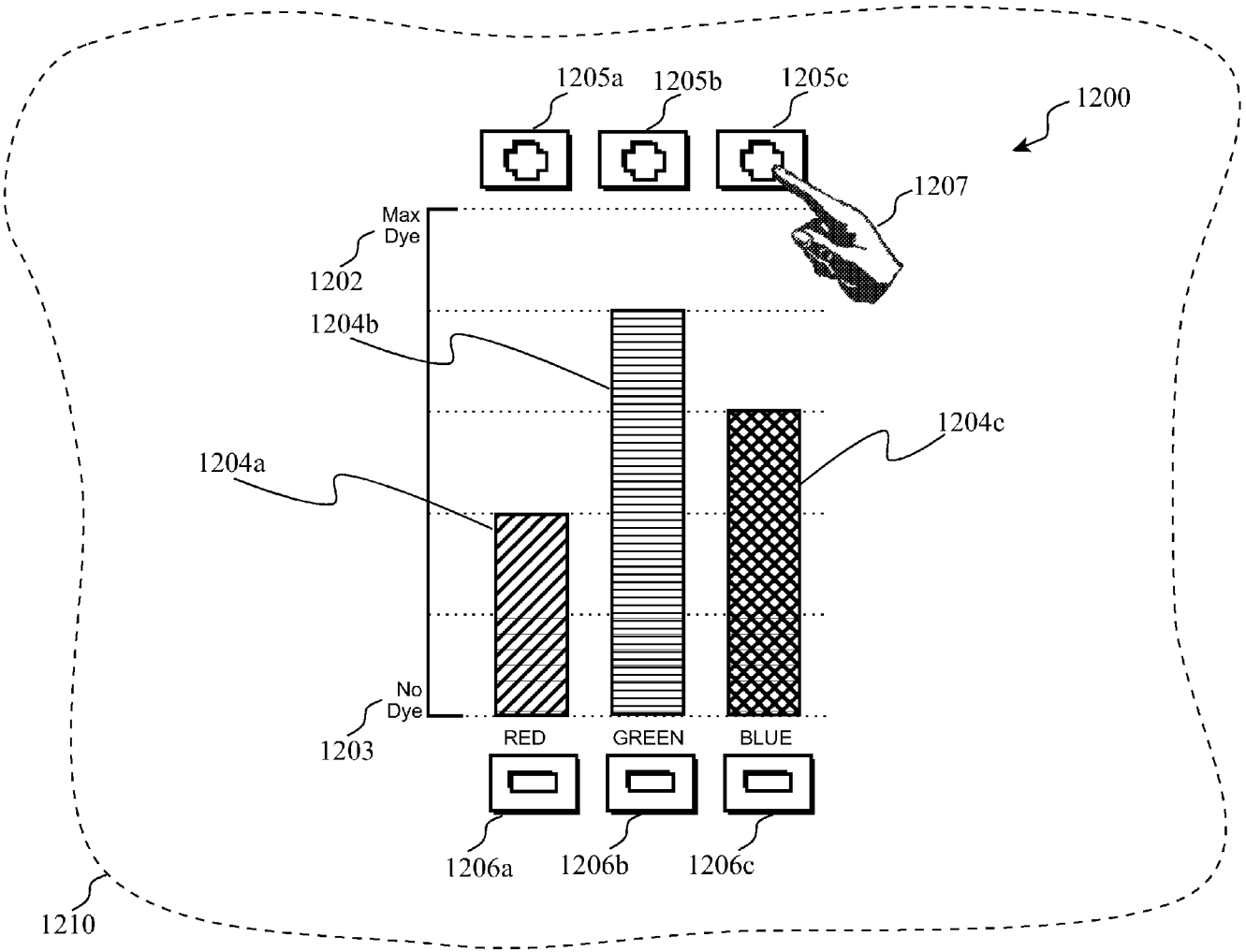
FIG. 12 shows an example user interface dialog for graphically setting thresholds for each component of dye or color detected in the bath liquid in a washing machine.

Turning now to FIG. 12, an example user interface dialog (1200) is shown on a portion of a screen or display (1201), such as a Liquid Crystal Display ("LCD"), Thin-Film Transistor ("TFT") or plasma panel, Cathode Ray Tube ("CRT"), or other user display device, for controlling or abating color bleed in a washing machine.

A pointer (1207), which may be a stylus, an icon controlled by a pointing device (e.g. mouse, trackball, etc.), or even a human finger in the case of a touch-screen display, is used to increase (1205*a*, 1205*b*, 1205*c*) or decrease (1206*a*, 1206*b*, 1206*c*) color components to set maximum levels of dye in the bath liquid. Preferably, the color components are primary colors such as red/green/blue, primary pigments such as red/yellow/blue, or subtractive primary pigments magenta/yellow/cyan.

The graphical depiction preferably is of a bar graph type, which ranges from a minimum or "no dye" level detected in the bath liquid, to a maximum dye level detectable in the bath liquid.

Figure 13:
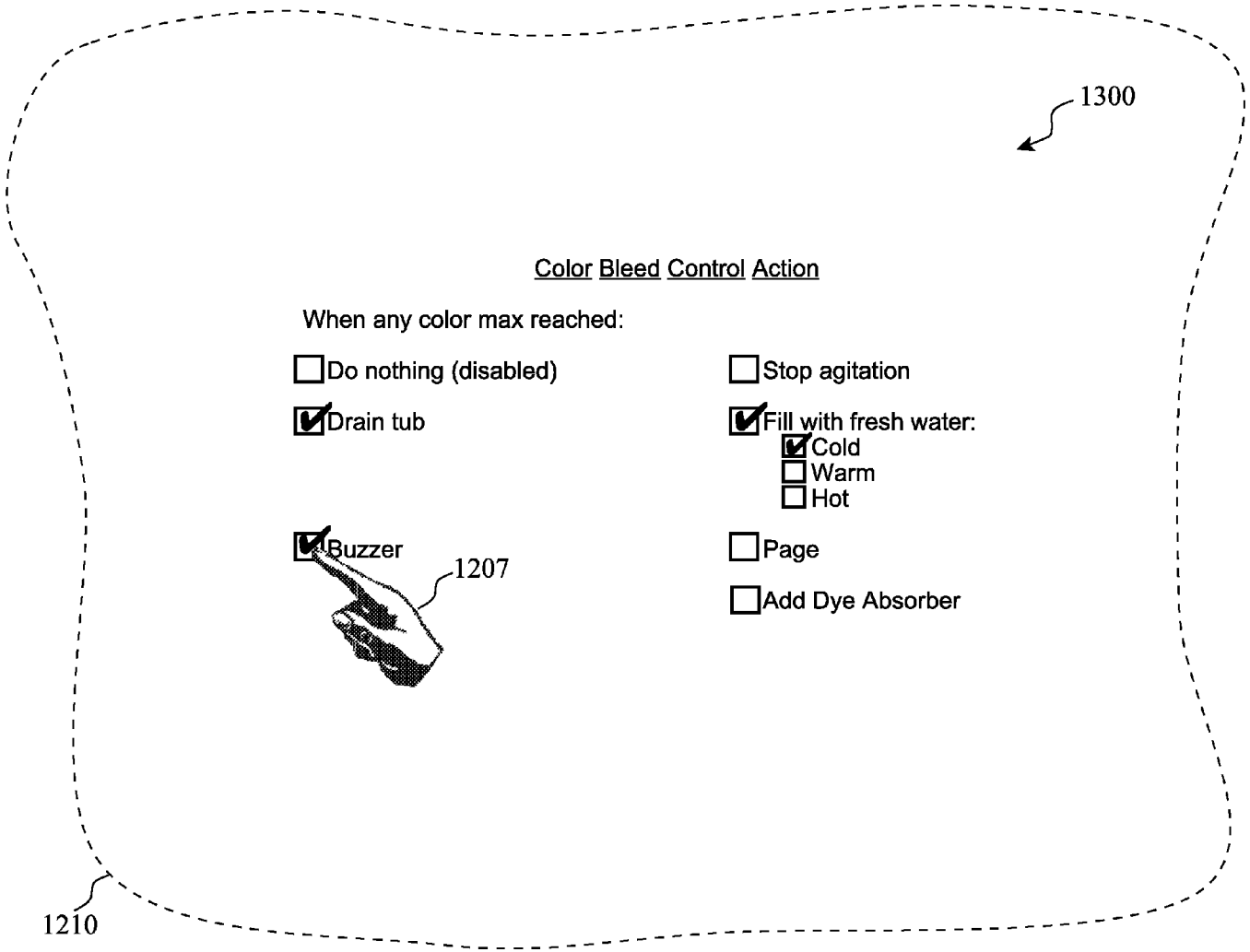
FIG. 13 shows an example user interface dialog for enabling one or more actions to be taken to control color bleed based on the thresholds set in FIG. 12.

FIG. 13 shows a user interface dialog (1300) for setting the control actions to be taken upon detection of one or more of the dye components in excess of the thresholds established using the dialog (1200) of FIG. 12. These actions may include, but are not limited to, doing nothing (e.g. disabling the control), stopping the wash agitator, draining the bath liquid from the tub, filling the tub with fresh water of a specified temperature, actuating a buzzer or bell, releasing a dye absorber or dye transfer inhibitor material, and even advanced communications actions such as sending a pager message, sending an email, or making a telephone call.

Figure 14:
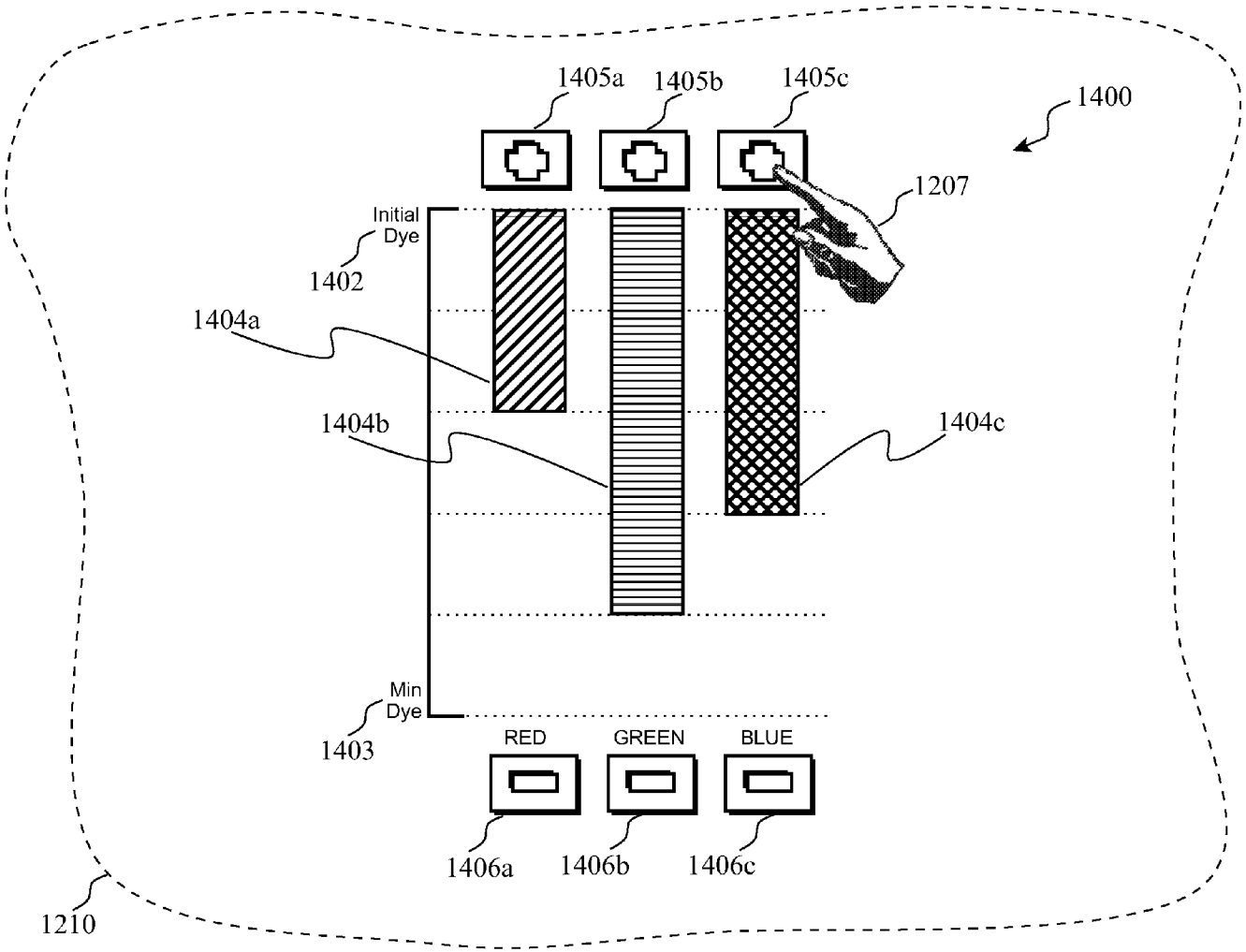
FIG. 14 shows an example user interface dialog for graphically setting thresholds for each component of dye or color detected in the bath liquid in a fabric dying system.

FIG. 14 illustrates a similar user interface dialog (1400) for controlling a commercial dying machine. In this case, it is desirable to transfer some dye, but not too much dye, to the fabric in the bath liquid. So, the graphical scale (1402, 1403) ranges from an initial level of dye in the liquid to a minimum in the liquid. As the process progresses, the fabric absorbs each color of dye over time, thus reducing the dye components. When a minimum level has been reached, the fabric has absorbed a desired amount of dye. Thus, the user is provided icons or buttons to increase (1405*a*, 1405*b*, 1405*c*) or decrease (1406*a*, 1406*b*, 1406*c*) each color component's minimum level (1404*a*, 1404*b*, 1404*c*) which is to trigger a control action.

Figure 15:
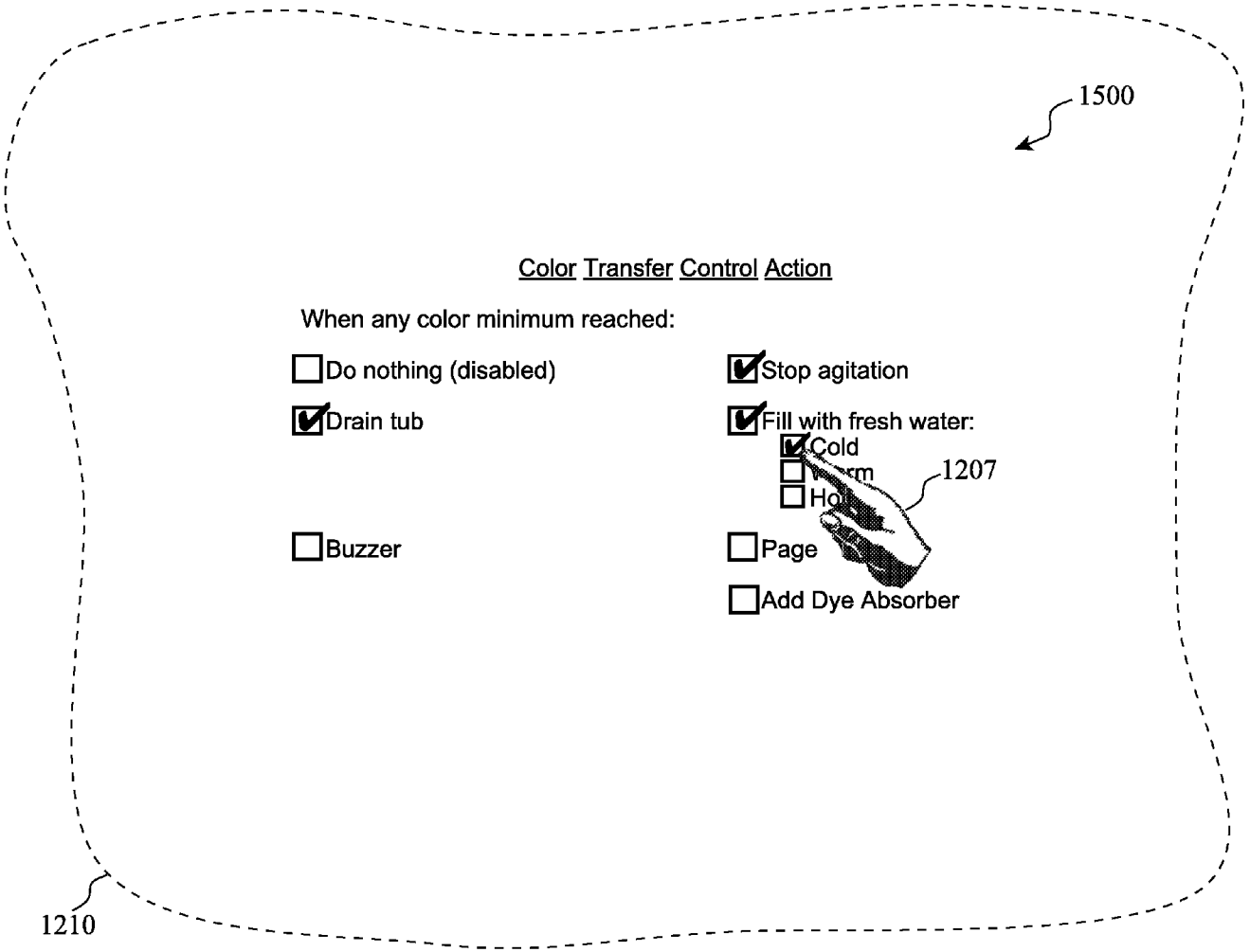
FIG. 15 shows an example user interface dialog for enabling one or more actions to be taken to control dying of fabrics based on the thresholds set in FIG. 13.

Likewise, FIG. 15 illustrates a user dialog (1500) in which the color transfer control actions to be taken when one or more dye component minimums has been reached, including but not limited to doing nothing (e.g. disabling the control), stopping the fabric agitator, draining the bath liquid from the tub, filling the tub with fresh water of a specified temperature, actuating a buzzer or bell, releasing a dye absorber or dye transfer inhibitor material, and even advanced communications actions such as sending a pager message, sending an email, or making a telephone call.

Suitable Computing Platform

In one embodiment of the invention, the functionality of the control logic, including the previously described logical processes, is performed in part or wholly by software executed by a computer, such as an embedded microcontroller, a personal computer, a web server, a web browser, or even an appropriately capable portable computing platform, such as personal digital assistant ("PDA"), web-enabled wireless telephone, or other type of personal information management ("PIM") device.

Therefore, it is useful to review a generalized architecture of a computing platform which may span the range of implementation, from a high-end web or enterprise server platform, to a personal computer, to a portable PDA or web-enabled wireless phone.

Figure 2A:
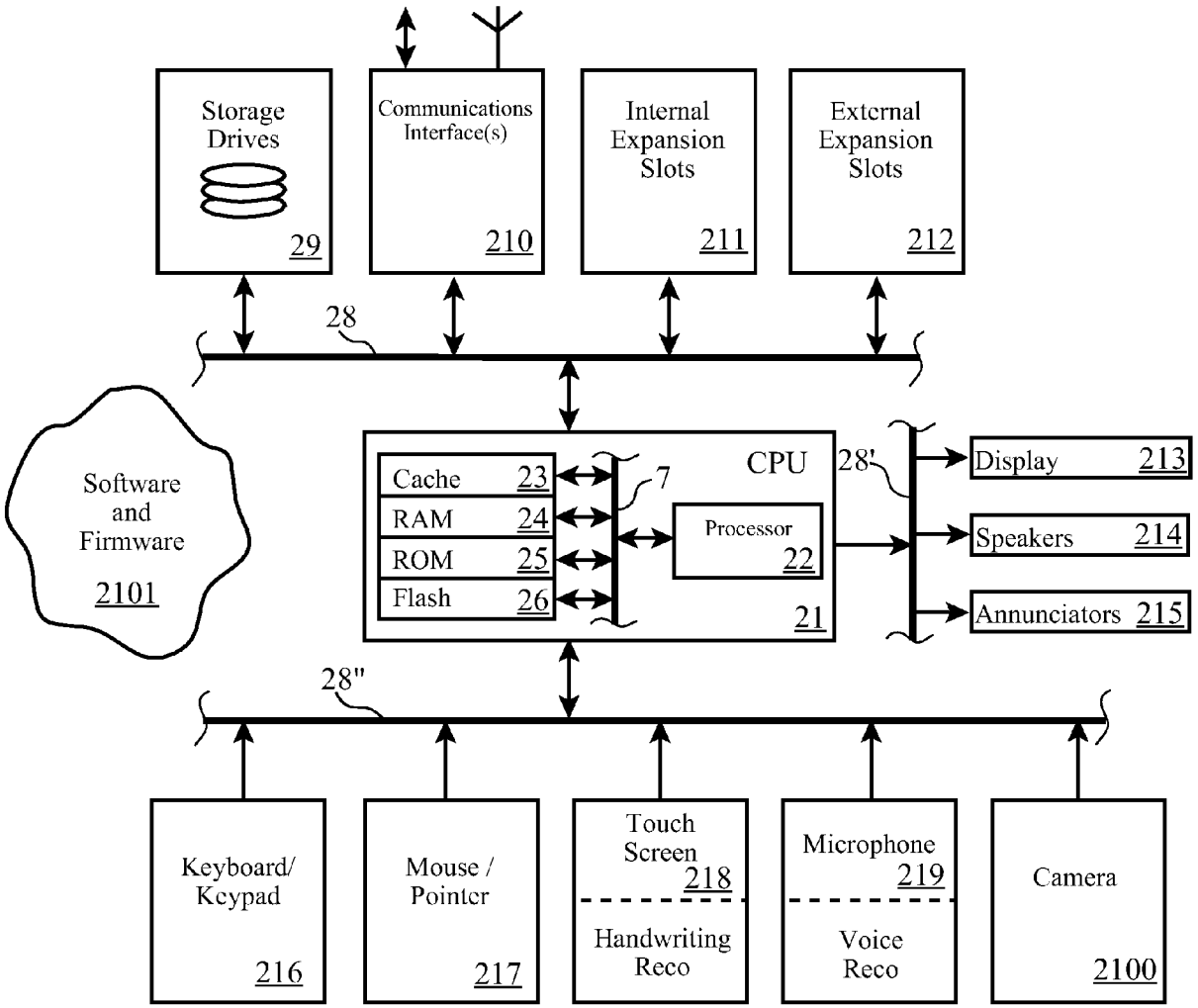
FIGS. 2*a* and 2*b* show a generalized computing platform architecture, and a generalized organization of software and firmware of such a computing platform architecture.

Turning to FIG. 2*a*, a generalized architecture is presented including a central processing unit (21) ("CPU"), which is typically comprised of a microprocessor (22) associated with random access memory ("RAM") (24) and read-only memory ("ROM") (25). Often, the CPU (21) is also provided with cache memory (23) and programmable FlashROM (26). The interface (27) between the microprocessor (22) and the various types of CPU memory is often referred to as a "local bus", but also may be a more generic or industry standard bus.

Many computing platforms are also provided with one or more storage drives (29), such as a hard-disk drives ("HDD"), floppy disk drives, compact disc drives (CD, CD-R, CD-RW, DVD, DVD-R, etc.), and proprietary disk and tape drives (e.g., Iomega Zip™ and Jaz™, Addonics SuperDisk™, etc.). Additionally, some storage drives may be accessible over a computer network.

Many computing platforms are provided with one or more communication interfaces (210), according to the function intended of the computing platform. For example, a personal computer is often provided with a high speed serial port (RS-232, RS-422, etc.), an enhanced parallel port ("EPP"), and one or more universal serial bus ("USB") ports. The computing platform may also be provided with a local area network ("LAN") interface, such as an Ethernet card, and other high-speed interfaces such as the High Performance Serial Bus IEEE-1394.

Computing platforms such as wireless telephones and wireless networked PDA's may also be provided with a radio frequency ("RF") interface with antenna, as well. In some cases, the computing platform may be provided with an infrared data arrangement ("IrDA") interface, too.

Computing platforms are often equipped with one or more internal expansion slots (211), such as Industry Standard Architecture ("ISA"), Enhanced Industry Standard Architecture ("EISA"), Peripheral Component Interconnect ("PCI"), or proprietary interface slots for the addition of other hardware, such as sound cards, memory boards, and graphics accelerators.

Additionally, many units, such as laptop computers and PDA's, are provided with one or more external expansion slots (212) allowing the user the ability to easily install and remove hardware expansion devices, such as PCMCIA cards, SmartMedia cards, and various proprietary modules such as removable hard drives, CD drives, and floppy drives.

Often, the storage drives (29), communication interfaces (210), internal expansion slots (211) and external expansion slots (212) are interconnected with the CPU (21) via a standard or industry open bus architecture (28), such as ISA, EISA, or PCI. In many cases, the bus (28) may be of a proprietary design.

A computing platform is usually provided with one or more user input devices, such as a keyboard or a keypad (216), and mouse or pointer device (217), and/or a touch-screen display (218). In the case of a personal computer, a full size keyboard is often provided along with a mouse or pointer device, such as a track ball or TrackPoint™. In the case of a web-enabled wireless telephone, a simple keypad may be provided with one or more function-specific keys. In the case of a PDA, a touch-screen (218) is usually provided, often with handwriting recognition capabilities.

Additionally, a microphone (219), such as the microphone of a web-enabled wireless telephone or the microphone of a personal computer, is supplied with the computing platform. This microphone may be used for simply reporting audio and voice signals, and it may also be used for entering user choices, such as voice navigation of web sites or auto-dialing telephone numbers, using voice recognition capabilities.

Many computing platforms are also equipped with a camera device (2100), such as a still digital camera or full motion video digital camera.

One or more user output devices, such as a display (213), are also provided with most computing platforms. The display (213) may take many forms, including a Cathode Ray Tube ("CRT"), a Thin Flat Transistor ("TFT") array, or a simple set of light emitting diodes ("LED") or liquid crystal display ("LCD") indicators.

One or more speakers (214) and/or annunciators (215) are often associated with computing platforms, too. The speakers (214) may be used to reproduce audio and music, such as the speaker of a wireless telephone or the speakers of a personal computer. Annunciators (215) may take the form of simple beep emitters or buzzers, commonly found on certain devices such as PDAs and PIMs.

These user input and output devices may be directly interconnected (28', 28") to the CPU (21) via a proprietary bus structure and/or interfaces, or they may be interconnected through one or more industry open buses such as ISA, EISA, PCI, etc.

The computing platform is also provided with one or more software and firmware (2101) programs to implement the desired functionality of the computing platforms.

Figure 2B:
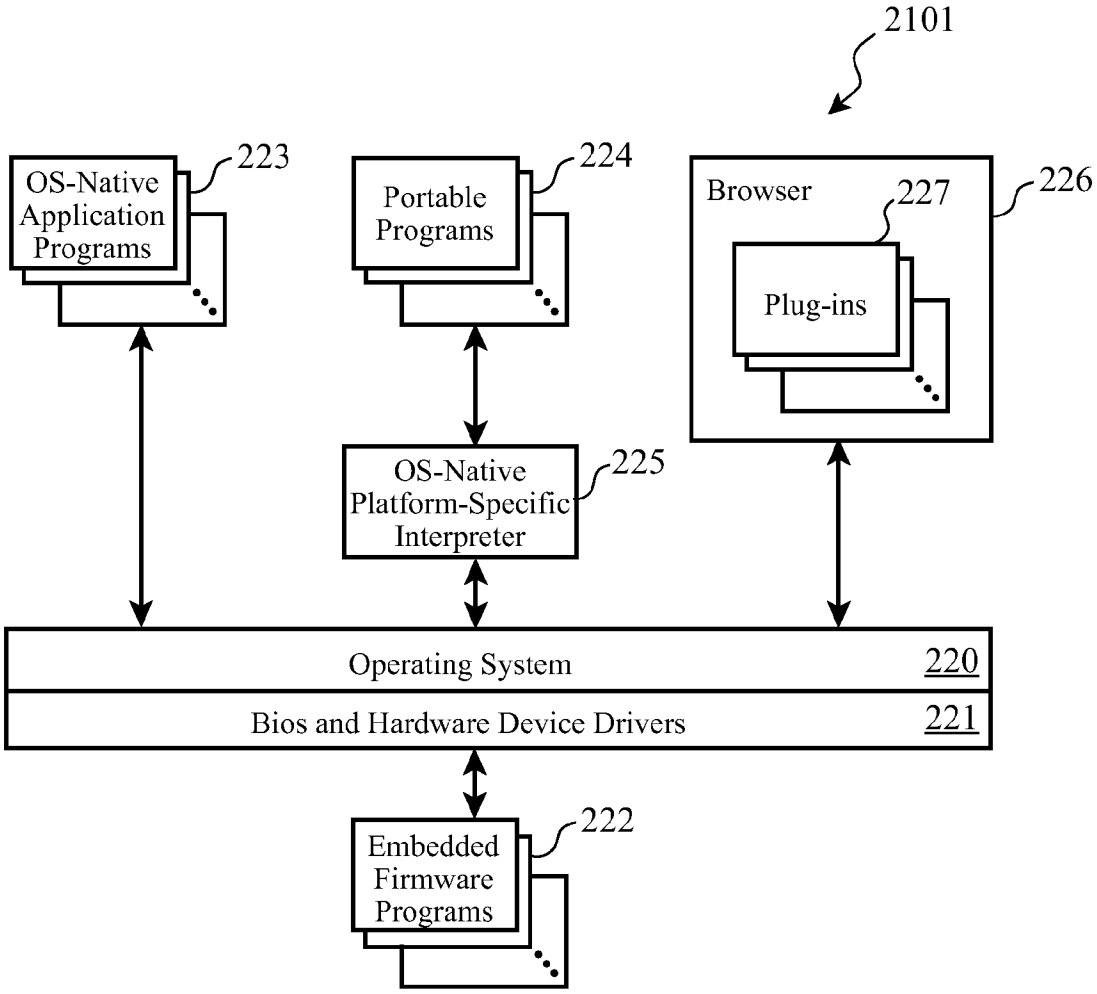

Turning to now FIG. 2*b*, more detail is given of a generalized organization of software and firmware (2101) on this range of computing platforms. One or more operating system ("OS") native application programs (223) may be provided on the computing platform, such as word processors, spreadsheets, contact management utilities, address book, calendar, email client, presentation, financial and bookkeeping programs.

Additionally, one or more "portable" or device-independent programs (224) may be provided, which must be interpreted by an OS-native platform-specific interpreter (225), such as Java™ scripts and programs.

Often, computing platforms are also provided with a form of web browser or micro-browser (226), which may also include one or more extensions to the browser such as browser plug-ins (227).

The computing device is often provided with an operating system (220), such as Microsoft Windows™, UNIX, IBM OS/2™, IBM AIX™, open source LINUX, Apple's MAC OS™, or other platform specific operating systems. Smaller devices such as PDA's and wireless telephones may be equipped with other forms of operating systems such as real-time operating systems ("RTOS") or Palm Computing's PalmOS™.

A set of basic input and output functions ("BIOS") and hardware device drivers (221) are often provided to allow the operating system (220) and programs to interface to and control the specific hardware functions provided with the computing platform.

Additionally, one or more embedded firmware programs (222) are commonly provided with many computing platforms, which are executed by onboard or "embedded" microprocessors as part of the peripheral device, such as a micro controller or a hard drive, a communication processor, network interface card, or sound or graphics card.

As such, FIGS. 2*a* and 2*b* describe in a general sense the various hardware components, software and firmware programs of a wide variety of computing platforms, including but not limited to personal computers, PDAs, PIMs, web-enabled telephones, and other appliances such as WebTV™ units. As such, we now turn our attention to disclosure of the present invention relative to the processes and methods preferably implemented as software and firmware on such a computing platform. It will be readily recognized by those skilled in the art that the following methods and processes may be alternatively realized as hardware functions, in part or in whole, without departing from the spirit and scope of the invention.

Service-Based Embodiments

Alternative embodiments of the present invention include some or all of the foregoing logical processes and functions of the invention being provided by configuring software, deploying software, downloading software, distributing software, or remotely serving clients in an on-demand environment, to provide the logical control processes of the advanced washing machine.

Software Deployment Embodiment. According to one embodiment of the invention, the methods and processes of the invention are distributed or deployed as a service by a service provider to a client's computing system(s).

Figure 3A:
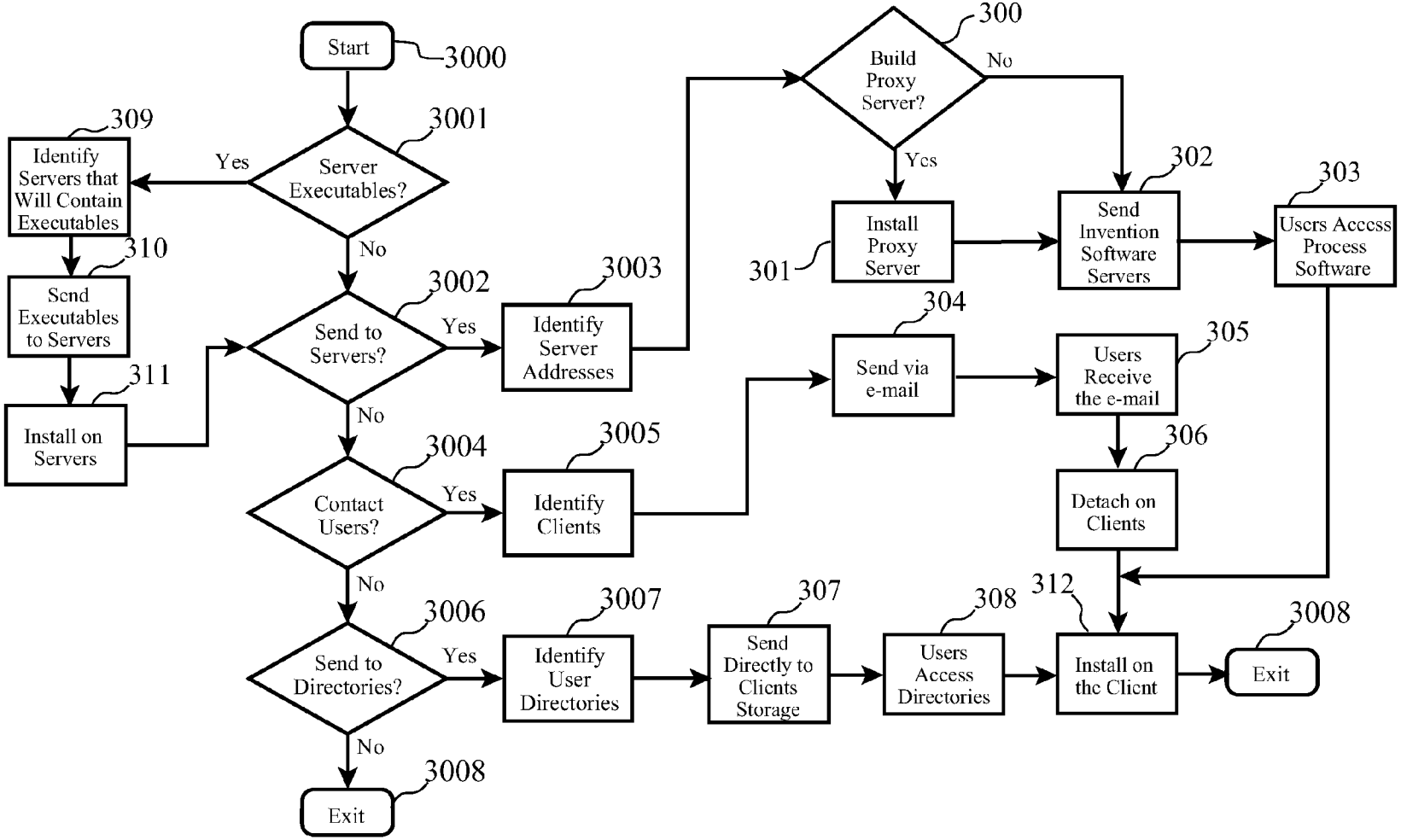
FIG. 3*a* sets forth a logical process to deploy software to a client in which the deployed software embodies the methods and processes of the present invention.

Turning to FIG. 3*a*, the deployment process begins (3000) by determining (3001) if there are any programs that will reside on a server or servers when the process software is executed. If this is the case then the servers that will contain the executables are identified (309). The process software for the server or servers is transferred directly to the servers storage via FTP or some other protocol or by copying through the use of a shared files system (310). The process software is then installed on the servers (311).

Next a determination is made on whether the process software is to be deployed by having users access the process software on a server or servers (3002). If the users are to access the process software on servers then the server addresses that will store the process software are identified (3003).

In step (3004) a determination is made whether the process software is to be developed by sending the process software to users via e-mail. The set of users where the process software will be deployed are identified together with the addresses of the user client computers (3005). The process software is sent via e-mail to each of the user's client computers. The users then receive the e-mail (305) and then detach the process software from the e-mail to a directory on their client computers (306). The user executes the program that installs the process software on his client computer (312) then exits the process (3008).

A determination is made if a proxy server is to be built (300) to store the process software. A proxy server is a server that sits between a client application, such as a Web browser, and a real server. It intercepts all requests to the real server to see if it can fulfill the requests itself. If not, it forwards the request to the real server. The two primary benefits of a proxy server are to improve performance and to filter requests. If a proxy server is required then the proxy server is installed (301). The process software is sent to the servers either via a protocol such as FTP or it is copied directly from the source files to the server files via file sharing (302). Another embodiment would be to send a transaction to the servers that contained the process software and have the server process the transaction, then receive and copy the process software to the server's file system. Once the process software is stored at the servers, the users via their client computers, then access the process software on the servers and copy to their client computers file systems (303). Another embodiment is to have the servers automatically copy the process software to each client and then run the installation program for the process software at each client computer. The user executes the program that installs the process software on his client computer (312) then exits the process (3008).

Lastly, a determination is made on whether the process software will be sent directly to user directories on their client computers (3006). If so, the user directories are identified (3007). The process software is transferred directly to the user's client computer directory (307). This can be done in several ways such as but not limited to sharing of the file system directories and then copying from the sender's file system to the recipient user's file system or alternatively using a transfer protocol such as File Transfer Protocol ("FTP"). The users access the directories on their client file systems in preparation for installing the process software (308). The user executes the program that installs the process software on his client computer (312) then exits the process (3008).

Software Integration Embodiment. According to another embodiment of the present invention, software embodying the methods and processes disclosed herein are integrated as a service by a service provider to other software applications, applets, or computing systems.

Integration of the invention generally includes providing for the process software to coexist with applications, operating systems and network operating systems software and then installing the process software on the clients and servers in the environment where the process software will function.

Generally speaking, the first task is to identify any software on the clients and servers including the network operating system where the process software will be deployed that are required by the process software or that work in conjunction with the process software. This includes the network operating system that is software that enhances a basic operating system by adding networking features. Next, the software applications and version numbers will be identified and compared to the list of software applications and version numbers that have been tested to work with the process software. Those software applications that are missing or that do not match the correct version will be upgraded with the correct version numbers. Program instructions that pass parameters from the process software to the software applications will be checked to ensure the parameter lists matches the parameter lists required by the process software. Conversely parameters passed by the software applications to the process software will be checked to ensure the parameters match the parameters required by the process software. The client and server operating systems including the network operating systems will be identified and compared to the list of operating systems, version numbers and network software that have been tested to work with the process software. Those operating systems, version numbers and network software that do not match the list of tested operating systems and version numbers will be upgraded on the clients and servers to the required level.

After ensuring that the software, where the process software is to be deployed, is at the correct version level that has been tested to work with the process software, the integration is completed by installing the process software on the clients and servers.

Figure 3B:
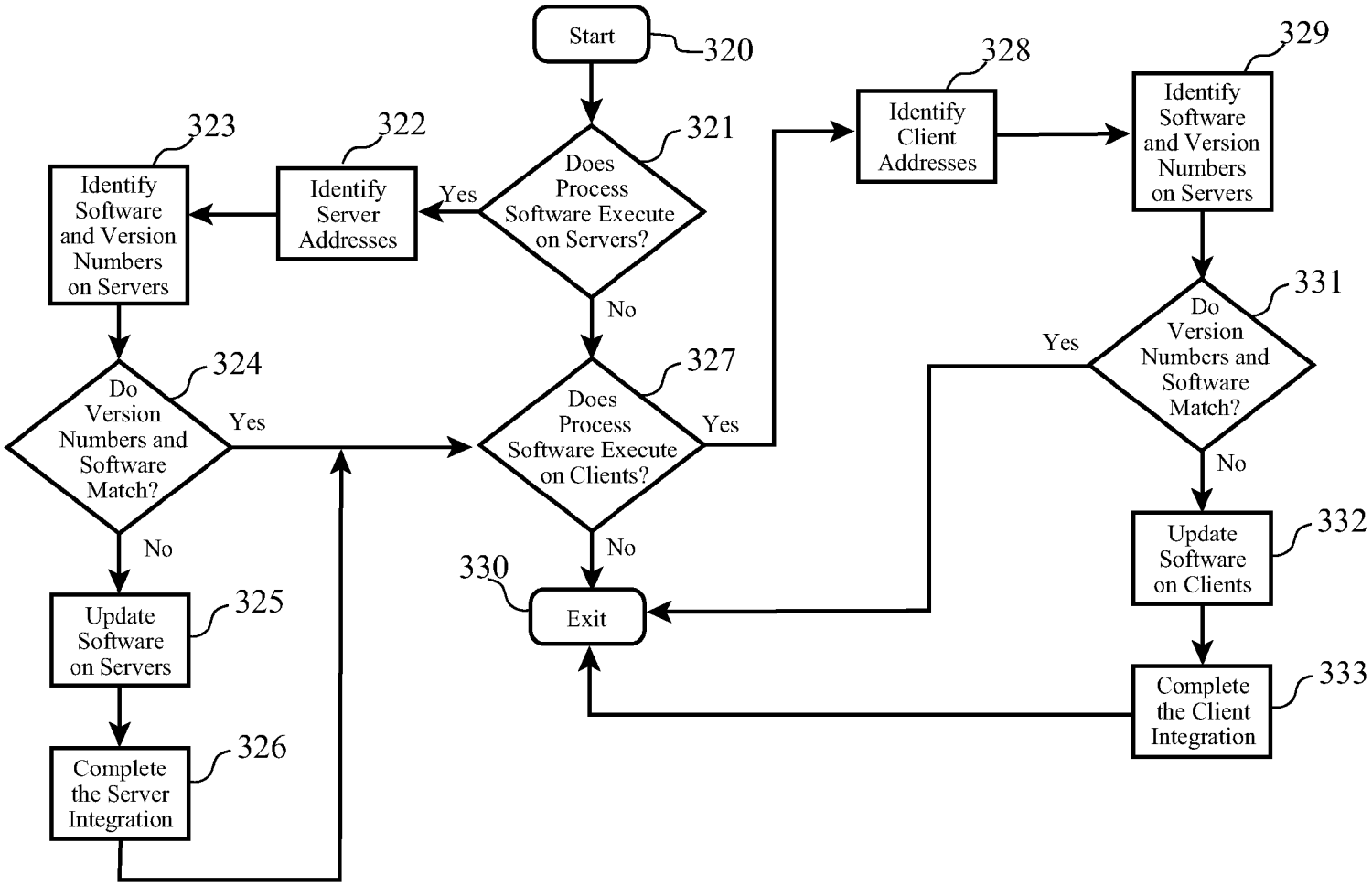
FIG. 3*b* sets for a logical process to integrate software to other software programs in which the integrated software embodies the methods and processes of the present invention.

Turning to FIG. 3*b*, details of the integration process according to the invention are shown. Integrating begins (320) by determining if there are any process software programs that will execute on a server or servers (321). If this is not the case, then integration proceeds to (327). If this is the case, then the server addresses are identified (322). The servers are checked to see if they contain software that includes the operating system ("OS"), applications, and network operating systems ("NOS"), together with their version numbers, that have been tested with the process software (323). The servers are also checked to determine if there is any missing software that is required by the process software (323).

A determination is made if the version numbers match the version numbers of OS, applications and NOS that have been tested with the process software (324). If all of the versions match and there is no missing required software the integration continues in (327).

If one or more of the version numbers do not match, then the unmatched versions are updated on the server or servers with the correct versions (325). Additionally if there is missing required software, then it is updated on the server or servers (325). The server integration is completed by installing the process software (326).

Step (327) which follows either (321), (324), or (326) determines if there are any programs of the process software that will execute on the clients. If no process software programs execute on the clients the integration proceeds to (330) and exits. If this is not the case, then the client addresses are identified (328).

The clients are checked to see if they contain software that includes the operating system ("OS"), applications, and network operating systems ("NOS"), together with their version numbers, that have been tested with the process software (329). The clients are also checked to determine if there is any missing software that is required by the process software (329).

A determination is made if the version numbers match the version numbers of OS, applications and NOS that have been tested with the process software 331. If all of the versions match and there is no missing required software, then the integration proceeds to (330) and exits.

If one or more of the version numbers do not match, then the unmatched versions are updated on the clients with the correct versions (332). In addition, if there is missing required software then it is updated on the clients (332). The client integration is completed by installing the process software on the clients (333). The integration proceeds to (330) and exits.

On-Demand Computing Services Embodiment. According to another aspect of the present invention, the processes and methods disclosed herein are provided through an on-demand computing architecture to render service to a client by a service provider.

Figure 3C:
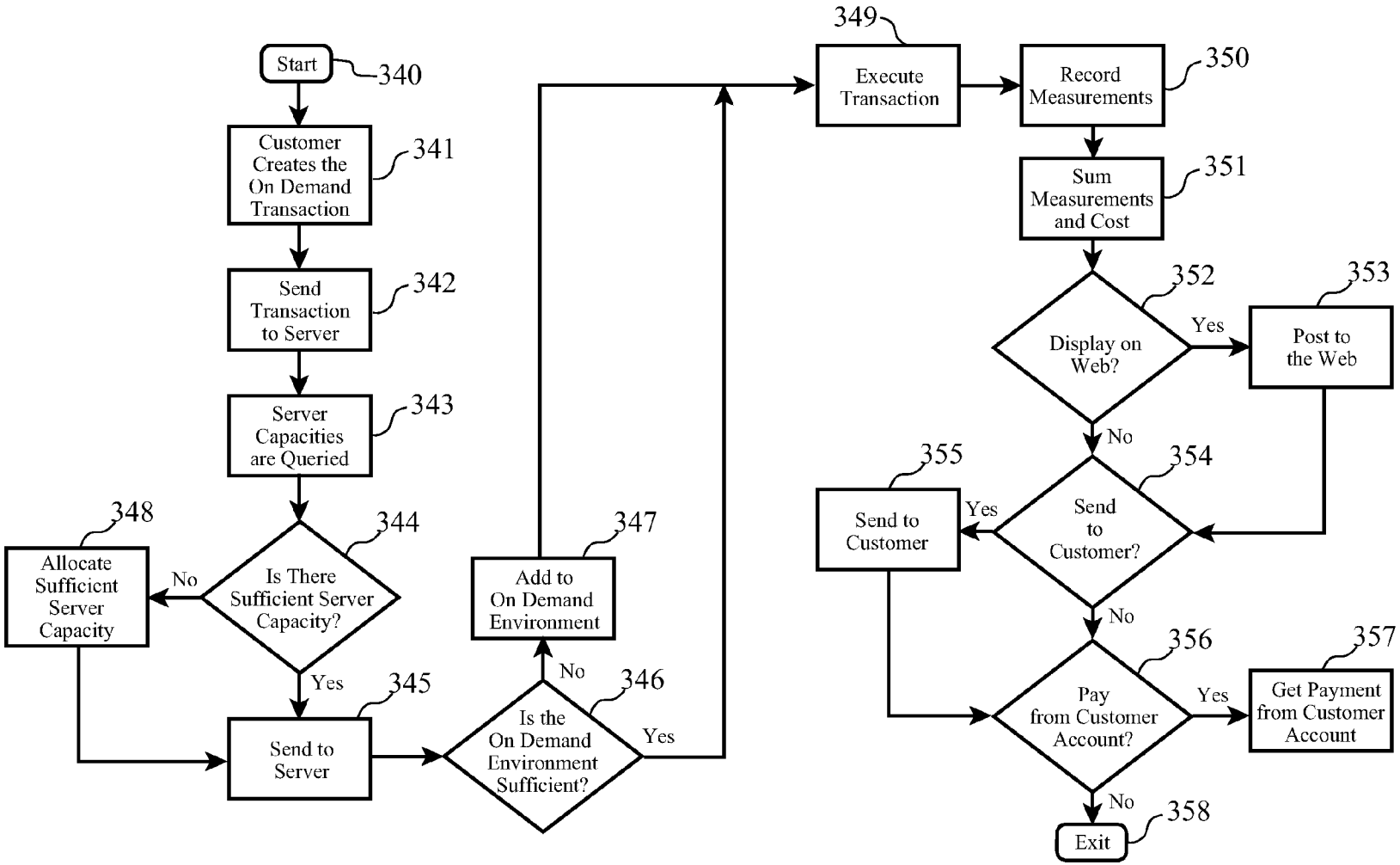
FIG. 3*c* sets for a logical process to execute software on behalf of a client in an on-demand computing system, in which the executed software embodies the methods and processes of the present invention.

Turning to FIG. 3*c*, generally speaking, the process software embodying the methods disclosed herein is shared, simultaneously serving multiple customers in a flexible, automated fashion. It is standardized, requiring little customization and it is scalable, providing capacity on demand in a pay-as-you-go model.

The process software can be stored on a shared file system accessible from one or more servers. The process software is executed via transactions that contain data and server processing requests that use CPU units on the accessed server. CPU units are units of time such as minutes, seconds, hours on the central processor of the server. Additionally the assessed server may make requests of other servers that require CPU units. CPU units are an example that represents but one measurement of use. Other measurements of use include but are not limited to network bandwidth, memory usage, storage usage, packet transfers, complete transactions, etc.

When multiple customers use the same process software application, their transactions are differentiated by the parameters included in the transactions that identify the unique customer and the type of service for that customer. All of the CPU units and other measurements of use that are used for the services for each customer are recorded. When the number of transactions to any one server reaches a number that begins to effect the performance of that server, other servers are accessed to increase the capacity and to share the workload. Likewise when other measurements of use such as network bandwidth, memory usage, storage usage, etc. approach a capacity so as to effect performance, additional network bandwidth, memory usage, storage etc. are added to share the workload.

The measurements of use used for each service and customer are sent to a collecting server that sums the measurements of use for each customer for each service that was processed anywhere in the network of servers that provide the shared execution of the process software. The summed measurements of use units are periodically multiplied by unit costs and the resulting total process software application service costs are alternatively sent to the customer and are indicated on a web site accessed by the computer which then remits payment to the service provider.

In another embodiment, the service provider requests payment directly from a customer account at a banking or financial institution.

In another embodiment, if the service provider is also a customer of the customer that uses the process software application, the payment owed to the service provider is reconciled to the payment owed by the service provider to minimize the transfer of payments.

FIG. 3*c* sets forth a detailed logical process which makes the present invention available to a client through an On Demand process. A transaction is created that contains the unique customer identification, the requested service type and any service parameters that further specify the type of service (341). The transaction is then sent to the main server (342). In an On Demand environment the main server can initially be the only server, then as capacity is consumed other servers are added to the On Demand environment.

The server central processing unit ("CPU") capacities in the On Demand environment are queried (343). The CPU requirement of the transaction is estimated, then the servers available CPU capacity in the On Demand environment are compared to the transaction CPU requirement to see if there is sufficient CPU available capacity in any server to process the transaction (344). If there is not sufficient server CPU available capacity, then additional server CPU capacity is allocated to process the transaction (348). If there was already sufficient available CPU capacity then the transaction is sent to a selected server (345).

Before executing the transaction, a check is made of the remaining On Demand environment to determine if the environment has sufficient available capacity for processing the transaction. This environment capacity consists of such things as but not limited to network bandwidth, processor memory, storage etc. (345). If there is not sufficient available capacity, then capacity will be added to the On Demand environment (347). Next the required software to process the transaction is accessed, loaded into memory, then the transaction is executed (349).

The usage measurements are recorded (350). The usage measurements consists of the portions of those functions in the On Demand environment that are used to process the transaction. The usage of such functions as, but not limited to, network bandwidth, processor memory, storage and CPU cycles are what is recorded. The usage measurements are summed, multiplied by unit costs and then recorded as a charge to the requesting customer (351).

If the customer has requested that the On Demand costs be posted to a web site (352) then they are posted (353). If the customer has requested that the On Demand costs be sent via e-mail to a customer address (354) then they are sent (355). If the customer has requested that the On Demand costs be paid directly from a customer account (356) then payment is received directly from the customer account (357). The last step is to exit the On Demand process.

VPN Deployment Embodiment. According to another aspect of the present invention, the methods and processes described herein may be embodied in part or in entirety in software which can be deployed to third parties as part of a service, wherein a third party VPN service is offered as a secure deployment vehicle or wherein a VPN is built on-demand as required for a specific deployment.

A virtual private network ("VPN") is any combination of technologies that can be used to secure a connection through an otherwise unsecured or untrusted network. VPNs improve security and reduce operational costs. The VPN makes use of a public network, usually the Internet, to connect remote sites or users together. Instead of using a dedicated, real-world connection such as leased line, the VPN uses "virtual" connections routed through the Internet from the company's private network to the remote site or employee. Access to the software via a VPN can be provided as a service by specifically constructing the VPN for purposes of delivery or execution of the process software (i.e. the software resides elsewhere) wherein the lifetime of the VPN is limited to a given period of time or a given number of deployments based on an amount paid.

The process software may be deployed, accessed and executed through either a remote-access or a site-to-site VPN. When using the remote-access VPNs the process software is deployed, accessed and executed via the secure, encrypted connections between a company's private network and remote users through a third-party service provider. The enterprise service provider ("ESP") sets a network access server ("NAS") and provides the remote users with desktop client software for their computers. The telecommuters can then dial a toll-free number to attach directly via a cable or DSL modem to reach the NAS and use their VPN client software to access the corporate network and to access, download and execute the process software.

When using the site-to-site VPN, the process software is deployed, accessed and executed through the use of dedicated equipment and large-scale encryption that are used to connect a company's multiple fixed sites over a public network such as the Internet.

The process software is transported over the VPN via tunneling which is the process of placing an entire packet within another packet and sending it over the network. The protocol of the outer packet is understood by the network and both points, called tunnel interfaces, where the packet enters and exits the network.

Figure 3D:
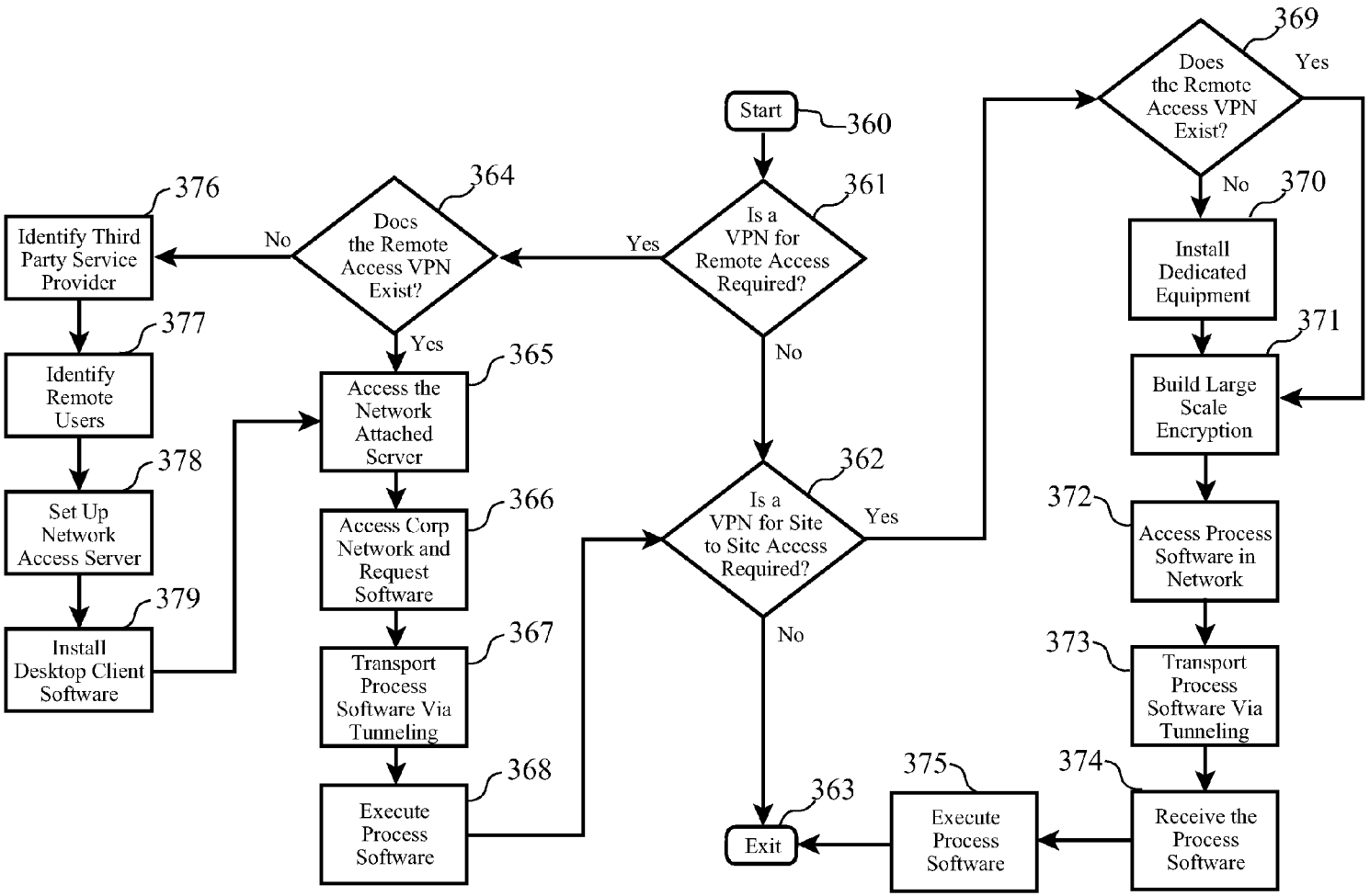
FIG. 3*d* sets for a logical process to deploy software to a client via a virtual private network, in which the deployed software embodies the methods and processes of the present invention.

Turning to FIG. 3*d*, VPN deployment process starts (360) by determining if a VPN for remote access is required (361). If it is not required, then proceed to (362). If it is required, then determine if the remote access VPN exits (364).

If a VPN does exist, then the VPN deployment process proceeds (365) to identify a third party provider that will provide the secure, encrypted connections between the company's private network and the company's remote users (376). The company's remote users are identified (377). The third party provider then sets up a network access server ("NAS") (378) that allows the remote users to dial a toll free number or attach directly via a broadband modem to access, download and install the desktop client software for the remote-access VPN (379).

After the remote access VPN has been built or if it has been previously installed, the remote users can access the process software by dialing into the NAS or attaching directly via a cable or DSL modem into the NAS (365). This allows entry into the corporate network where the process software is accessed (366). The process software is transported to the remote user's desktop over the network via tunneling. That is the process software is divided into packets and each packet including the data and protocol is placed within another packet (367). When the process software arrives at the remote user's desktop, it is removed from the packets, reconstituted and then is executed on the remote users desktop (368).

A determination is made to see if a VPN for site to site access is required (362). If it is not required, then proceed to exit the process (363). Otherwise, determine if the site to site VPN exists (369). If it does exist, then proceed to (372). Otherwise, install the dedicated equipment required to establish a site to site VPN (370). Then build the large scale encryption into the VPN (371).

After the site to site VPN has been built or if it had been previously established, the users access the process software via the VPN (372). The process software is transported to the site users over the network via tunneling. That is the process software is divided into packets and each packet including the data and protocol is placed within another packet (374). When the process software arrives at the remote user's desktop, it is removed from the packets, reconstituted and is executed on the site users desktop (375). Proceed to exit the process (363).

Computer-Readable Media Embodiments

In another embodiment of the invention, logical processes according to the invention for and described herein for controlling a washing machine are encoded on or in one or more computer-readable media. Some computer-readable media are read-only (e.g. they must be initially programmed using a different device than that which is ultimately used to read the data from the media), some are write-only (e.g. from the data encoders perspective they can only be encoded, but not read simultaneously), or read-write. Still some other media are write-once, read-many-times.

Some media are relatively fixed in their mounting mechanisms, while others are removable, or even transmittable. All computer-readable media form two types of systems when encoded with data and/or computer software: (a) when removed from a drive or reading mechanism, they are memory devices which generate useful data-driven outputs when stimulated with appropriate electromagnetic, electronic, and/or optical signals; and (b) when installed in a drive or reading device, they form a data repository system accessible by a computer.

Figure 4A:
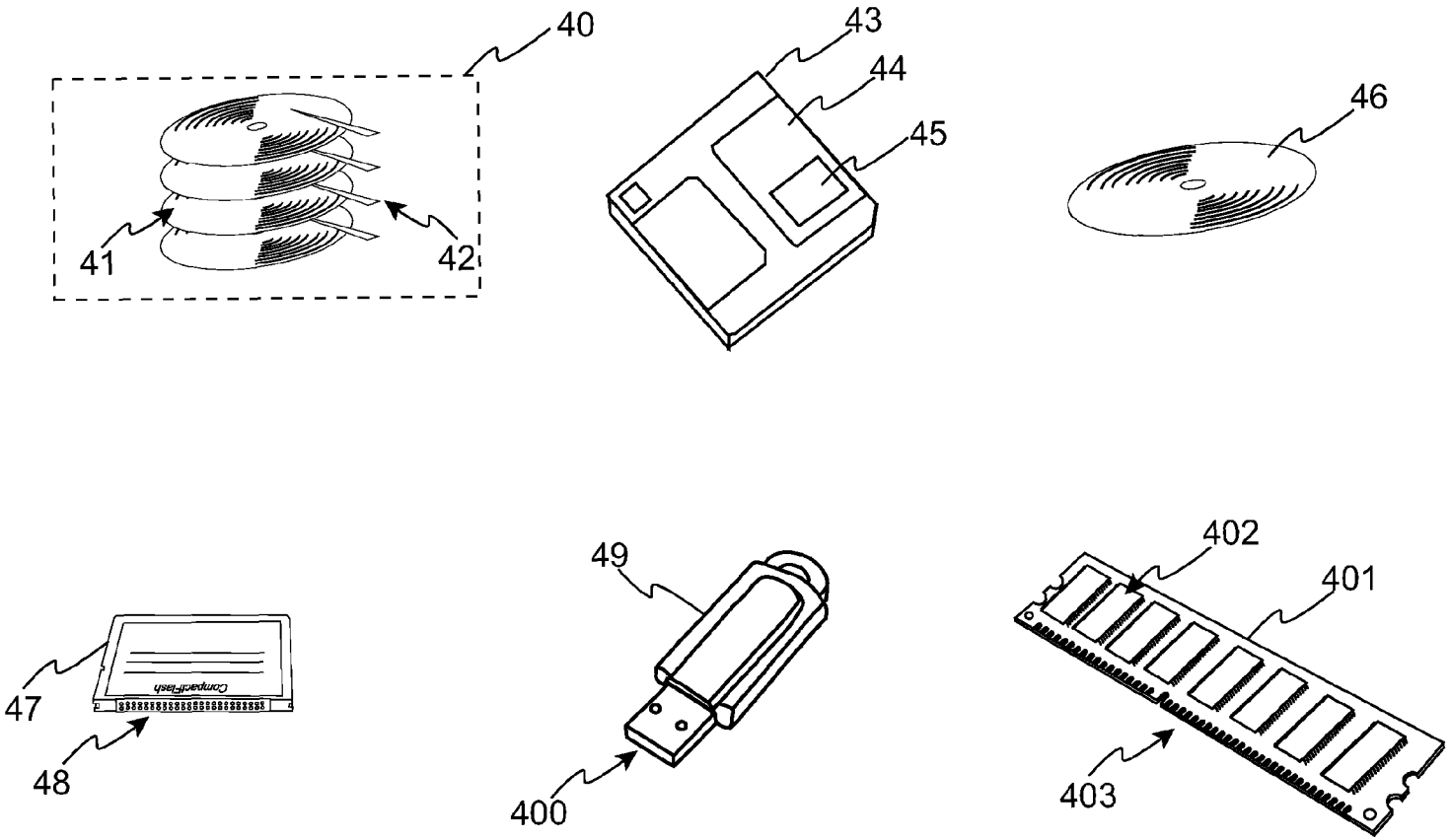
FIGS. 4*a*, 4*b* and 4*c*, illustrate computer readable media of various removable and fixed types, signal transceivers, and parallel-to-serial-to-parallel signal circuits.

FIG. 4*a* illustrates some computer readable media including a computer hard drive (40) having one or more magnetically encoded platters or disks (41), which may be read, written, or both, by one or more heads (42). Such hard drives are typically semi-permanently mounted into a complete drive unit, which may then be integrated into a configurable computer system such as a Personal Computer, Server Computer, or the like.

Similarly, another form of computer readable media is a flexible, removable "floppy disk" (43), which is inserted into a drive which houses an access head. The floppy disk typically includes a flexible, magnetically encodable disk which is accessible by the drive head through a window (45) in a sliding cover (44).

A Compact Disk ("CD") (46) is usually a plastic disk which is encoded using an optical and/or magneto-optical process, and then is read using generally an optical process. Some CD's are read-only ("CD-ROM"), and are mass produced prior to distribution and use by reading-types of drives. Other CD's are writable (e.g. "CD-RW", "CD-R"), either once or many time. Digital Versatile Disks ("DVD") are advanced versions of CD's which often include double-sided encoding of data, and even multiple layer encoding of data. Like a floppy disk, a CD or DVD is a removable media.

Another common type of removable media are several types of removable circuit-based (e.g. solid state) memory devices, such as Compact Flash ("CF")(47), Secure Data ("SD"), Sony's MemoryStick, Universal Serial Bus ("USB") FlashDrives and "Thumbdrives" (49), and others. These devices are typically plastic housings which incorporate a digital memory chip, such as a battery-backed random access chip ("RAM"), or a Flash Read-Only Memory ("FlashROM"). Available to the external portion of the media is one or more electronic connectors (48, 400) for engaging a connector, such as a CF drive slot or a USB slot. Devices such as a USB FlashDrive are accessed using a serial data methodology, where other devices such as the CF are accessed using a parallel methodology. These devices often offer faster access times than disk-based media, as well as increased reliability and decreased susceptibility to mechanical shock and vibration. Often, they provide less storage capability than comparably priced disk-based media.

Yet another type of computer readable media device is a memory module (403), often referred to as a SIMM or DIMM. Similar to the CF, SD, and FlashDrives, these modules incorporate one or more memory devices (402), such as Dynamic RAM ("DRAM"), mounted on a circuit board (401) having one or more electronic connectors for engaging and interfacing to another circuit, such as a Personal Computer motherboard. These types of memory modules are not usually encased in an outer housing, as they are intended for installation by trained technicians, and are generally protected by a larger outer housing such as a Personal Computer chassis.

Figure 4B:
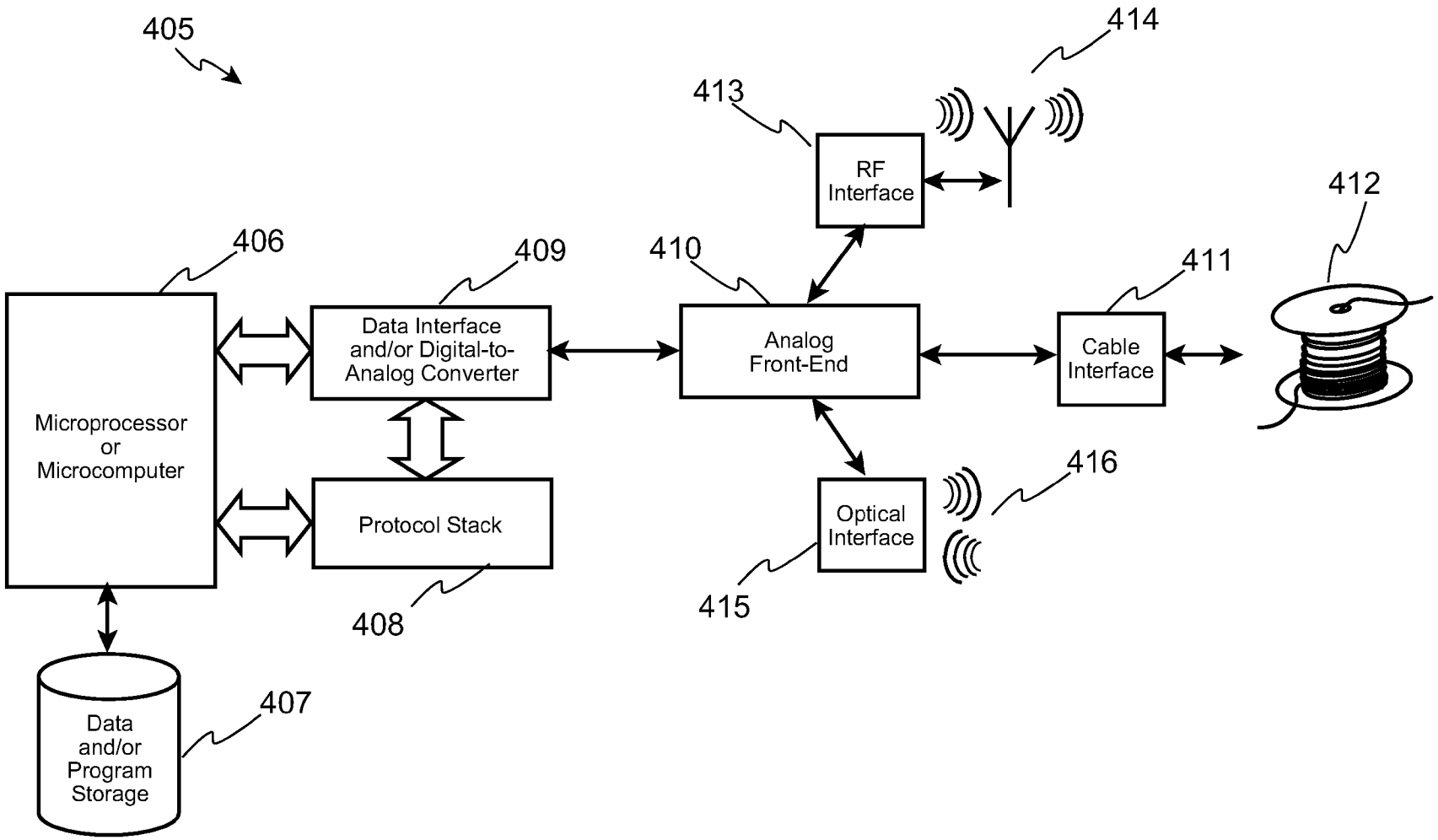

Turning now to FIG. 4*b*, another embodiment option (405) of the present invention is shown in which a computer-readable signal is encoded with software, data, or both, which implement logical processes according to the invention. FIG. 4*b* is generalized to represent the functionality of wireless, wired, electro-optical, and optical signaling systems. For example, the system shown in FIG. 4*b* can be realized in a manner suitable for wireless transmission over Radio Frequencies ("RF"), as well as over optical signals, such as InfraRed Data Arrangement ("IrDA"). The system of FIG. 4*b* may also be realized in another manner to serve as a data transmitter, data receiver, or data transceiver for a USB system, such as a drive to read the aforementioned USB FlashDrive, or to access the serially-stored data on a disk, such as a CD or hard drive platter.

In general, a microprocessor or microcontroller (406) reads, writes, or both, data to/from storage for data, program, or both (407). A data interface (409), optionally including a digital-to-analog converter, cooperates with an optional protocol stack (408), to send, receive, or transceive data between the system front-end (410) and the microprocessor (406). The protocol stack is adapted to the signal type being sent, received, or transceived. For example, in a Local Area Network ("LAN") embodiment, the protocol stack may implement Transmission Control Protocol/Internet Protocol ("TCP/IP"). In a computer-to-computer or computer-to-periperal embodiment, the protocol stack may implement all or portions of USB, "FireWire", RS-232, Point-to-Point Protocol ("PPP"), etc.

The system's front-end, or analog front-end, is adapted to the signal type being modulated, demodulate, or transcoded. For example, in an RF-based (413) system, the analog front-end comprises various local oscillators, modulators, demodulators, etc., which implement signaling formats such as Frequency Modulation ("FM"), Amplitude Modulation ("AM"), Phase Modulation ("PM"), Pulse Code Modulation ("PCM"), etc. Such an RF-based embodiment typically includes an antenna (414) for transmitting, receiving, or transceiving electromagnetic signals via open air, water, earth, or via RF wave guides and coaxial cable. Some common open air transmission standards are BlueTooth, Global Services for Mobile Communications ("GSM"), Time Division Multiple Access ("TDMA"), Advanced Mobile Phone Service ("AMPS"), and Wireless Fidelity ("Wi-Fi").

In another example embodiment, the analog front-end may be adapted to sending, receiving, or transceiving signals via an optical interface (415), such as laser-based optical interfaces (e.g. Wavelength Division Multiplexed, SONET, etc.), or Infra Red Data Arrangement ("IrDA") interfaces (416). Similarly, the analog front-end may be adapted to sending, receiving, or transceiving signals via cable (412) using a cable interface, which also includes embodiments such as USB, Ethernet, LAN, twisted-pair, coax, Plain-old Telephone Service ("POTS"), etc.

Signals transmitted, received, or transceived, as well as data encoded on disks or in memory devices, may be encoded to protect it from unauthorized decoding and use. Other types of encoding may be employed to allow for error detection, and in some cases, correction, such as by addition of parity bits or Cyclic Redundancy Codes ("CRC"). Still other types of encoding may be employed to allow directing or "routing" of data to the correct destination, such as packet and frame-based protocols.

Figure 4C:
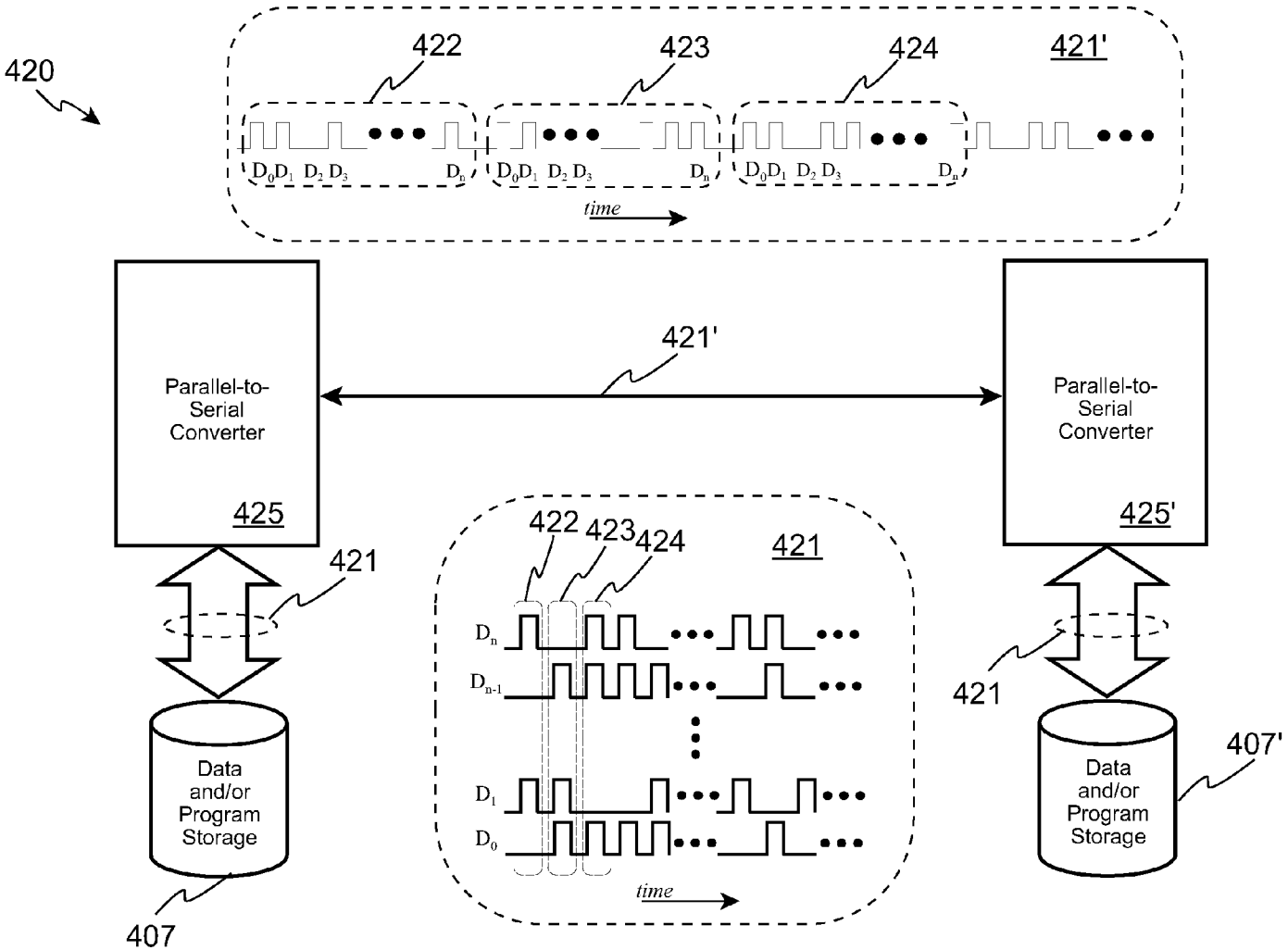

FIG. 4*c* illustrates conversion systems which convert parallel data to and from serial data. Parallel data is most often directly usable by microprocessors, often formatted in 8-bit wide bytes, 16-bit wide words, 32-bit wide double words, etc. Parallel data can represent executable or interpretable software, or it may represent data values, for use by a computer. Data is often serialized in order to transmit it over a media, such as an RF or optical channel, or to record it onto a media, such as a disk. As such, many computer-readable media systems include circuits, software, or both, to perform data serialization and re-parallelization.

Parallel data (421) can be represented as the flow of data signals aligned in time, such that parallel data unit (byte, word, d-word, etc.) (422, 423, 424) is transmitted with each bit $D_0$-$D_n$ being on a bus or signal carrier simultaneously, where the "width" of the data unit is n−1. In some systems, $D_0$ is used to represent the least significant bit ("LSB"), and in other systems, it represents the most significant bit ("MSB"). Data is serialized (421) by sending one bit at a time, such that each data unit (422, 423, 424) is sent in serial fashion, one after another, typically according to a protocol.

As such, the parallel data stored in computer memory (407, 407') is often accessed by a microprocessor or Parallel-to-Serial Converter (425, 425') via a parallel bus (421), and exchanged (e.g. transmitted, received, or transceived) via a serial bus (421'). Received serial data is converted back into parallel data before storing it in computer memory, usually. The serial bus (421') generalized in FIG. 4*c* may be a wired bus, such as USB or Firewire, or a wireless communications medium, such as a RF or optical channel, as previously discussed.

In these manners, various embodiments of the invention may be realized by encoding software, data, or both, according to the logical processes of the invention, into one or more computer-readable mediums, thereby yielding a product of manufacture and a system which, when properly read, received, or decoded, yields useful programming instructions, data, or both, including, but not limited to, the computer-readable media types described in the foregoing paragraphs.

Conclusion

While certain examples and details of various embodiments have been disclosed, it will be recognized by those skilled in the art that variations in implementation such as use of different programming methodologies, computing platforms, and processing technologies, may be adopted without departing from the spirit and scope of the present invention. Therefore, the scope of the invention should be determined by the following claims.

What is claimed is:

1. A system for controlling dye transfer comprising:

a user display portion of a washing machine having a user-operable selection device;

a first dialog shown on a portion of the user display and having one or more color level indicators for setting a threshold to trigger a dye transfer control action, and having one or more threshold adjustment controls operable by the selection device;

a second dialog having one or more control action enablers enabling one or more control actions to be taken upon detection of a color reaching the threshold;

at least one excess dye control enabled by the control action enablers, responsive to the threshold being triggered, performing one or more control action selected from the group consisting of releasing a dye absorber, and releasing a dye inhibitor, wherein the releasing is controlled by opening an abatement valve communicative to a reservoir holding a substantially liquid or gel form of a dye scavenger or inhibitor substance; and a controller which continues to monitor the triggering of the threshold, and responsive to the threshold being triggered, continues to release additional dye absorber, or dye inhibitor, or both dye absorber and dye inhibitor by opening the abatement valve until at least one condition is detected selected from the group consisting of a desired color threshold is met, a desired color threshold is regained, until a user intervention occurs, and until a particular wash stage is activated.

2. The system as set forth in claim 1 wherein the first dialog comprises three primary color threshold indicators.

3. The system as set forth in claim 1 wherein the first dialog comprises three primary pigment threshold indicators.

4. The system as set forth in claim 3 wherein the primary pigment threshold indicators comprise subtractive primary pigment indicators.

5. The system as set forth in claim 1 wherein the first dialog comprises a bar graph display.

6. The system as set forth in claim 1 wherein the selection device comprises a touch-screen display.

7. The system as set forth in claim 1 wherein the selection device comprises one or more devices selected from the group consisting of a pointer icon, a button, a slider, a knob and a digital number.

8. An automated method for controlling dye transfer comprising:

showing on a portion of a user display of a washing machine a dialog having one or more color level indicators for setting a threshold to trigger a dye transfer control action, and having one or more threshold adjustment controls operable by the selection device;

responsive to user operation of the threshold adjustment controls, changing one or more dye transfer control parameters for initiation of one or more control actions;

providing one or more user-operable control action enablers enabling one or more control actions to be taken upon detection of a color reaching the threshold;

responsive to user operation of the enablers, enabling one or more logical operations of a dye transfer control process which are to be performed in response to the color threshold being met;

according to the control action enablers and responsive to the threshold being triggered, performing one or more control actions selected from the group consisting of releasing a dye absorber, and releasing a dye inhibitor, wherein the releasing is controlled by opening an abatement valve communicative to a reservoir holding a substantially liquid or gel form of a dye scavenger or inhibitor substance; and continuing to monitor the triggering of the threshold, and responsive to the threshold being triggered, continues to release additional dye absorber, or dye inhibitor, or both dye absorber and dye inhibitor by opening the abatement valve until at least one condition is detected selected from the group consisting of a desired color threshold is met, a desired color threshold is regained, until a user intervention occurs, and until a particular wash stage is activated.

9. The method as set forth in claim 8 wherein the dialog comprises three primary color threshold indicators.

10. The method as set forth in claim 8 wherein the dialog comprises three primary pigment threshold indicators.

11. The method as set forth in claim 10 wherein the primary pigment threshold indicators comprise subtractive primary pigment indicators.

12. The method as set forth in claim 8 wherein the dialog comprises a bar graph display.

13. A computer program product for controlling dye transfer comprising:

a computer-readable storage memory device suitable for storage of computer-executable program;

first program code to show on a portion of a user display a dialog having one or more color level indicators for setting a threshold to trigger a dye transfer control action, and having one or more threshold adjustment controls operable by the selection device;

second program code to responsive to user operation of the threshold adjustment controls, change one or more dye transfer control parameters for initiation of one or more control actions and to provide one or more user-operable control action enablers enabling one or more control actions to be taken upon detection of a color reaching the threshold;

third program code to, responsive to user operation of the enablers, enable one or more logical operations of a dye transfer control process which are to be performed in response to the color threshold being met;

fourth program code to, according to the control action enablers and responsive to the threshold being triggered, performing one or more control actions selected from the group consisting of releasing a dye absorber, and releasing a dye inhibitor, wherein the releasing is controlled by opening an abatement valve communicative to a reservoir holding a substantially liquid or gel form of a dye scavenger or inhibitor substance, wherein the first, second, third and fourth programs are stored by the computer-readable storage memory; and fifth program code to continue to monitor the triggering of the threshold, and responsive to the threshold being triggered, to continue to release additional dye absorber, or dye inhibitor, or both dye absorber and dye inhibitor by opening the abatement valve until at least one condition is detected selected from the group consisting of a desired color threshold is met, a desired color threshold is regained, until a user intervention occurs, and until a particular wash stage is activated;

wherein the first, second, third, fourth and fifth program codes are stored by the computer-readable storage memory device.

14. The computer program product as set forth in claim 13 wherein the dialog comprises three primary color threshold indicators.

15. The computer program product as set forth in claim 13 wherein the dialog comprises three primary pigment threshold indicators.

16. The computer program product as set forth in claim 15 wherein the primary pigment threshold indicators comprise subtractive primary pigment indicators.

17. The computer program product as set forth in claim 13 wherein the dialog comprises a bar graph display.

18. The system as set forth in claim 1 further comprising at least a second control action selected from the group consisting of sending a pager message to the user, sending an electronic mail to the user and sending a telephone call to the user.

19. The method as set forth in claim 8 further comprising at least a second control action selected from the group consisting of sending a pager message to the user, sending an electronic mail to the user and sending a telephone call to the user.

20. The computer program product as set forth in claim 13 further comprising program code to perform at least a second control action selected from the group consisting of sending a pager message to the user, sending an electronic mail to the user and sending a telephone call to the user.

21. A system for controlling dye transfer comprising:

a display means for showing a user of a washing machine a dialog having one or more color level indicators for setting a threshold to trigger a dye transfer control action, and having one or more threshold adjustment controls operable by the selection device;

a dye transfer control means for, responsive to user operation of the threshold adjustment controls, changing one or more dye transfer control parameters for initiation of one or more control actions;

a user-operable control means for providing control action enablers enabling one or more control actions to be taken upon detection of a color reaching the threshold; and a enabler means for, responsive to user operation of the enablers, enabling one or more logical operations of a dye transfer control process which are to be performed in response to the color threshold being met;

a control means for, according to the enablers and responsive to the threshold being triggered, performing one or more control actions selected from the group consisting of releasing a dye absorber, and releasing a dye inhibitor, wherein the releasing is controlled by opening an abatement valve communicative to a reservoir holding a substantially liquid or gel form of a dye scavenger or inhibitor substance; and a continuation means for continuing to monitor the triggering of the threshold, and responsive to the threshold being triggered, continues to release additional dye absorber, or dye inhibitor, or both dye absorber and dye inhibitor by opening the abatement valve until at least one condition is detected selected from the group consisting of a desired color threshold is met, a desired color threshold is regained, until a user intervention occurs, and until a particular wash stage is activated.

* * * * *